US006834867B2

(12) United States Patent
Smith

(10) Patent No.: US 6,834,867 B2
(45) Date of Patent: Dec. 28, 2004

(54) ARTICULATED TWO-PIECE SNOWBOARD WITH CONNECTOR

(76) Inventor: Shane H. Smith, P.O. Box 6848-306, Big Bear Lake, CA (US) 92315

( * ) Notice: Subject to any disclaimer, the term of this patent is extended or adjusted under 35 U.S.C. 154(b) by 79 days.

(21) Appl. No.: 09/920,661

(22) Filed: Jul. 31, 2001

(65) Prior Publication Data

US 2002/0008361 A1 Jan. 24, 2002

Related U.S. Application Data

(63) Continuation-in-part of application No. 09/465,543, filed on Dec. 16, 1999, now Pat. No. 6,220,091.

(60) Provisional application No. 60/112,744, filed on Dec. 17, 1998, and provisional application No. 60/306,259, filed on Jul. 17, 2001.

(51) Int. Cl.[7] ..... B62B 9/04

(52) U.S. Cl. ..... 280/14.21; 280/603; 280/609; 280/15

(58) Field of Search ..... 280/602, 603, 280/606, 609, 610, 14.21, 14.22, 14.25, 14.26, 15, 16, 22, 28, 20, 842; D21/760, 766

(56) References Cited

U.S. PATENT DOCUMENTS 2,389,001 A * 11/1945 Schatz ..... 280/609
3,145,029 A * 8/1964 Ollanketo ..... 280/22
3,372,944 A * 3/1968 Lauritzen ..... 280/22
3,782,745 A * 1/1974 Stoveken ..... 280/18
4,161,324 A * 7/1979 Colvin ..... 280/14.2
4,221,394 A * 9/1980 Campbell ..... 280/14.2
4,305,603 A * 12/1981 Muller et al. ..... 280/607
5,411,282 A * 5/1995 Shannon ..... 280/606
5,613,695 A * 3/1997 Yu ..... 280/14.2
5,865,446 A 2/1999 Kobylenski et al.
5,868,405 A * 2/1999 Lavecchia et al. ..... 280/14.2
6,062,585 A * 5/2000 Hess ..... 280/608
6,270,091 B1 * 8/2001 Smith ..... 280/14.21
6,290,249 B1 * 9/2001 Wolf ..... 280/609

* cited by examiner

*Primary Examiner*—Brian L. Johnson
*Assistant Examiner*—Bryan Fischmann
(74) *Attorney, Agent, or Firm*—Edgar W. Averill, Jr.

(57) ABSTRACT

A two-piece articulated snowboard having a first section held to a second section by a connector. the connector is configured so that it permits some bending so that the longitudinal axis of the board bends at the connector. Preferably, the connector permits very little or no twisting so that the first and second sections stay in the same horizontal plane.

13 Claims, 27 Drawing Sheets

ARTICULATED TWO-PIECE SNOWBOARD WITH CONNECTOR

CROSS-REFERENCE TO RELATED APPLICATION

The present application is a continuation in part of applicant's application U.S. Ser. No. 09/465,543 filed Dec. 16, 1999 now U.S. Pat. No. 6,270,091. This application also claims the benefit of U.S. provisional application No. 60/112,744 filed Dec. 17, 1998 U.S. provisional application No. 60/306,259, filed Jul. 17, 2001.

BACKGROUND OF THE INVENTION

The field of the invention is sporting goods and the invention relates more particularly to snowboards, although boards made according to the teaching of the present invention can also be used on water or sand.

In the past, commercial snowboards have been limited in their ability to make sharp turns and maneuver over uneven surfaces and around moguls. In addition, they are awkward to store and transport.

U.S. Pat. No. 5,865,446 to Kobylenski, et al., attempted to address the limitations of the one-piece snowboard by creating an articulated two-piece snowboard that looks very much like a traditional snowboard cut in half and connected with flexible straps. Although the flexible connection appears to give the snowboard some additional maneuverability over a one-piece board by making one board into two shorter boards, the flexible connection results in some significant adverse maneuverability issues.

The bottom of the Kobylenski board is flat like a traditional, one-piece snowboard, so that each section still has problems moving over and around bumps and uneven surfaces. In addition, and most importantly, the snowboard still must be maneuvered using the edge of the board for turning and direction in a manner similar to the one-piece snowboard. This makes the snowboard less controllable using the stated design than one-piece snowboards for the following reason: by creating a flexible connection, the rider must now contend with two edges, one on each section. To maximize control, the full edge of each section needs to be in contact with the surface of the snow. In order for this to happen, the edges must remain in a straight line. This will require substantial effort on the part of the rider and the sections will normally not remain in a straight line.

The rider has two options when entering a turn, neither optimal. In the first, the forward foot will be angled into the turn while the trailing foot will tend to be pointed in the original direction. The weight will be on the front foot to make the turn, engaging the full edge of the front section, but with reduced effectiveness, since the edge of the back section is used only minimally—the turn is being performed primarily by the edge of the front section. If the rider inadvertently shifts his weight to the back section, that section will want to maintain the original direction and the board could easily become uncontrollable. In the second method of making the turn, the rider will have more equal weight on both sections, and the angle between the longitudinal axis of both sections will be less than 180 degrees on the side that is being turned toward. The problem with this approach is that only a fraction of the full edge of both sections will be engaged. This will result in decreased turning performance when compared to a one-piece snowboard.

The primary advantage becomes the primary disadvantage, since the flex in the middle prevents full engagement of both sections' edges. In summary, the use of Kobylenski's design of a two-piece snowboard with a flexible connector while retaining the same turning method that is used in the one-piece snowboard creates a board that is difficult to control in a turn.

The present invention introduces an entirely new design for snowboards, comprising two sections with a uniquely shaped convex bottom and joined with a connector. Quite different than the traditional flat-surfaced bottom, the bottom surface of the snowboard of the present invention is not only convex front to back, like the traditional snowboard, but in the preferred embodiment, also somewhat convex side to side. This allows it to move around and through rough, bumpy surfaces, including moguls. The convex bottom has one or more ridges which are used to maneuver and turn the board. The edge of the board is no longer the primary means of turning the board. The ridges are strategically placed on the bottom surface to accommodate various types of terrain and ride. Angled blades can be incorporated in the bottom surface for more aggressive turning capability. Shallow, blunt ridges are best used for fast downhill rides with fewer turns; deeper, sharper ridges are better suited for tighter turns and slower maneuvering. In the preferred embodiment, a springable connector provides enough flex for the rider to alternate turning first one direction, then the other, as the rider glides downhill, while the semi-rigid and non-twisting aspects of the connector provide the rigidity necessary to maintain control.

The sections can be disconnected for each transport and storage. A user can customize and modify the performance of the invention by: (a) interchanging sections with sections of differing physical and performance characteristics; (b) changing or moving ridges or blades on a section; and/or (c) changing to a different style of connector for joining the two sections.

BRIEF SUMMARY OF THE INVENTION

The present invention is an articulated, two-piece snowboard with separate front and rear sections joined together with a connector, each section providing a platform for one foot. In the preferred embodiment, the bottom surfaces of the sections are convex, with longitudinal ridges along the bottom; the sections are connected with a non-twisting, semi-rigid, springable connector. The sections may be detached from the connector for the purpose of transporting the snowboard or for the purpose of substituting a section or connector with different characteristics.

DESCRIPTION OF THE PREFERRED EMBODIMENTS

Figure 1:
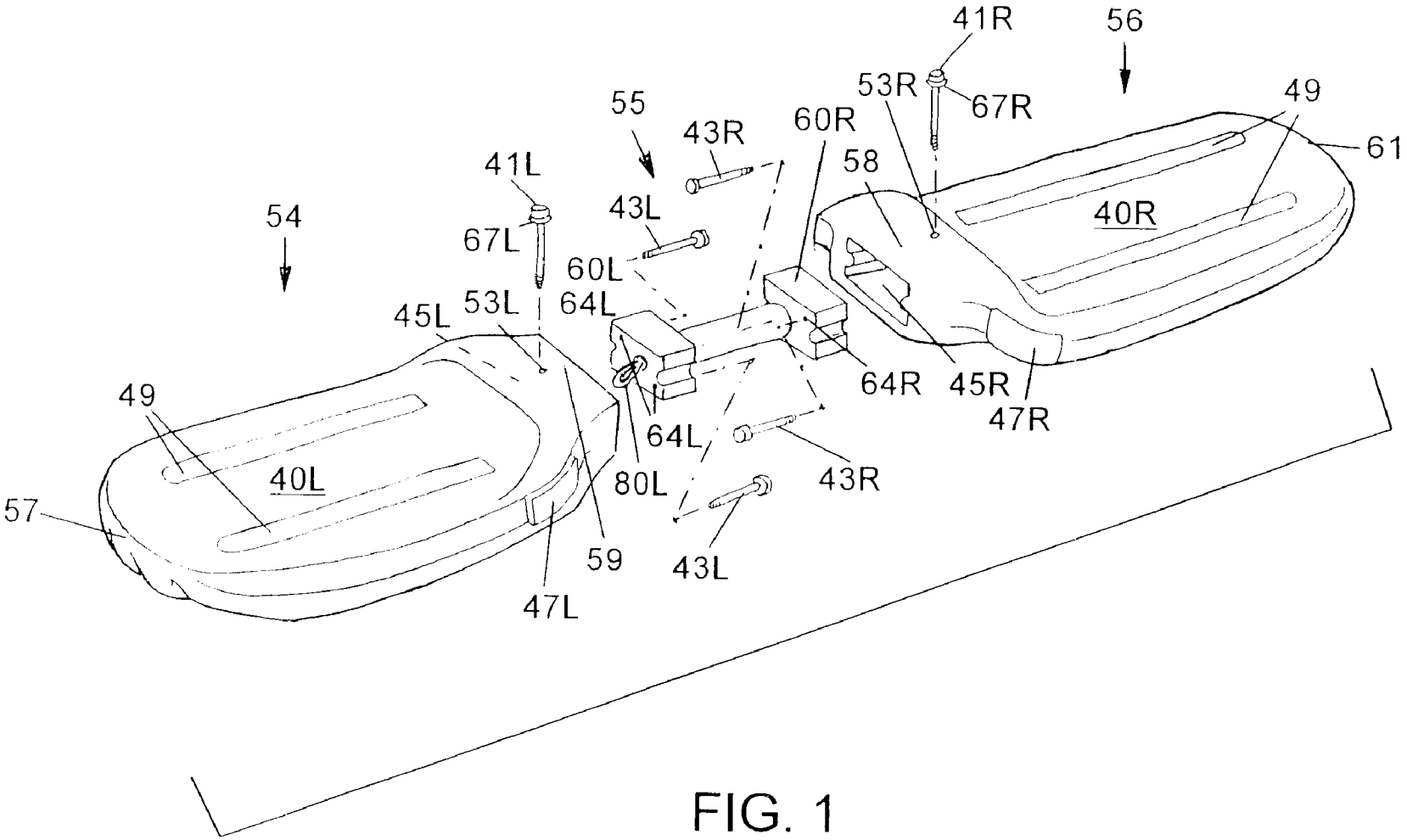
FIG. 1 is an exploded perspective view of the invention of the parent application of the present application.

The preferred embodiment of the present invention, as best shown in FIG. 1, comprises a front section 54 and a rear section 56 joined with a springable connection assembly 55. Although front section 54 and rear section 56 are depicted as identical, they may differ in size, shape or construction to alter the performance characteristics of the invention. The rider of the invention will place one foot on section 54 and one foot on section 56, preferably with feet at angles to the longitudinal axis in a stance similar to that used by traditional snowboarders.

Connection of the Three Primary Parts of the Invention: Front Section, Rear Section and Springable Connection Assembly.

FIG. 1 illustrates how the three primary pieces of the invention, the front section, the rear section, and the springable connection assembly, are attached to one another. To connect the front section and the rear section to the springable connection assembly, block 60R, preferably rectangular, is inserted into a slot, hollow or mating cavity 45R and block 60L is inserted into the slot, hollow or mating cavity 45L. Block 60L is primarily secured by two bolts 43L which are inserted into two holes 64L in the block and into threaded sleeves or holes in the wall of the mating cavity 45L. In addition, a bolt 41L is inserted through washer 67L into sleeve or hole 53L, where it passes through loop 80L of the connection assembly and into a threaded receptacle and tightened. The purpose of bolt 41L is to prevent separation of section 54 from the connection assembly in the event that bolts 43L fail under stress. In the same manner, block 60R is primarily secured by two bolts 43R which are inserted into two holes 64R in the block and into threaded sleeves or holes in the wall of the mating cavity 45R. In addition, a bolt 41R is inserted through washer 67R into sleeve or hole 53R, where it passes through loop 80R of the connection assembly and into a threaded receptacle and tightened. The purpose of bolt 41R is to prevent separation of section 54 from the connection assembly in the event that bolts 43R fail under stress.

Front Section: Shape and Outer Surface.

Figure 2:
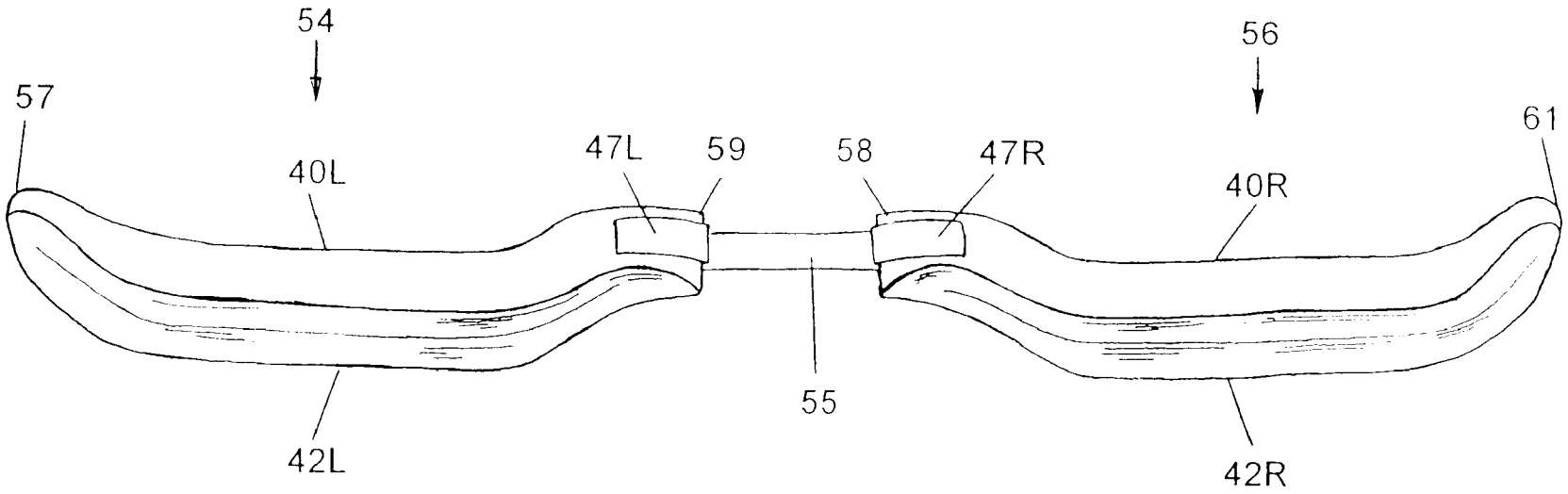
FIG. 2 is a side view thereof.
Figure 8:
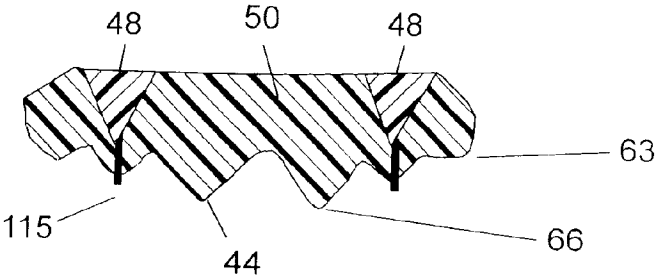
FIG. 8 is a sectional view taken along line 8—8 of FIG. 7.
Figure 9:
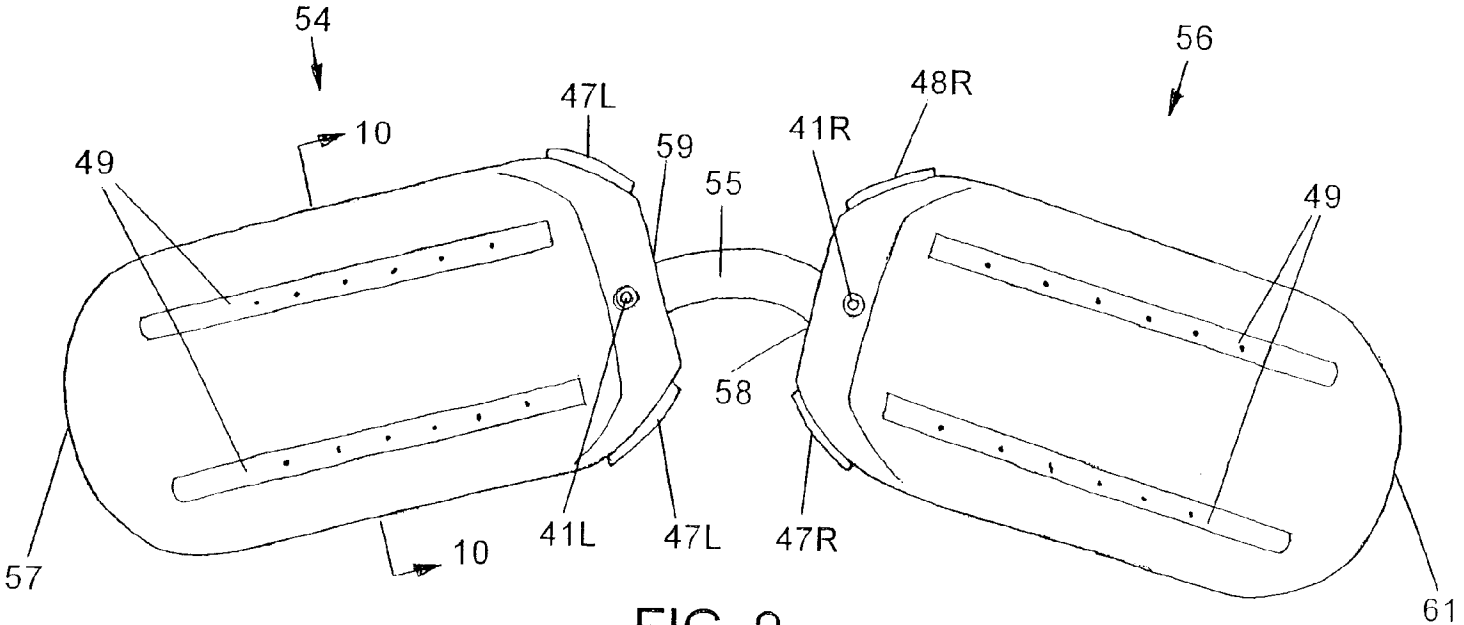
FIG. 9 is a plan view thereof as it would appear in a turn.
Figure 10:
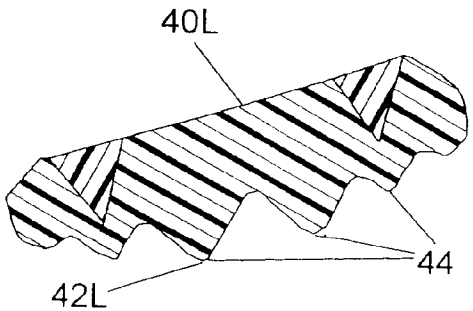
FIG. 10 is a cross-sectional view taken along line 10—10 of FIG. 9.
Figure 11:
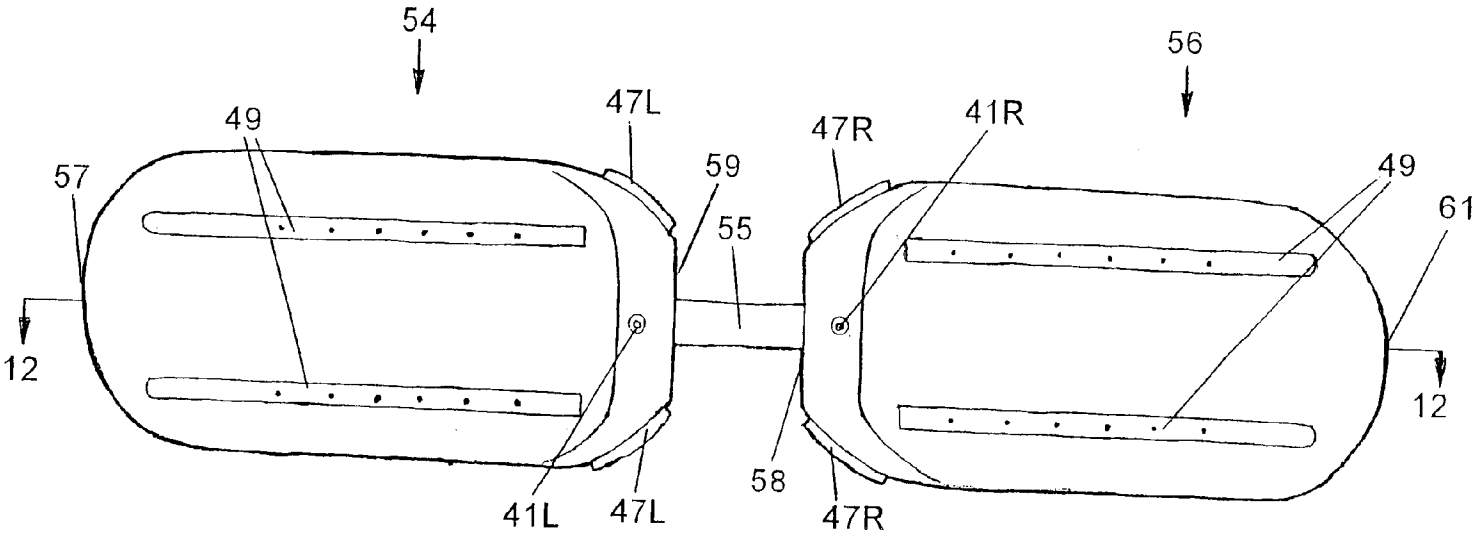
FIG. 11 is a plan view thereof.

The front section has a convex-shaped bottom the bottom surface of the section is not only convex parallel to the longitudinal axis as shown in FIG. 2, bit is also preferably convex perpendicular to the longitudinal axis, as shown in cross-sectional view in FIG. 8. This would usually mean that the lowest part 66 of the bottom surface is lower than the outside edges 63 of the bottom surface. The outside edges 63 are usually rounded or curved upward to prevent the edges 63 from digging into the snow, except when usage may require less rounding and more of a sharp or pointed edge, such as steep terrain or stunt riding. The leading edge 57 in FIG. 2 is curved upward somewhat. The top surface 40L of said front section is used as a platform for one of the rider's feet. Two rigid strips 49, shown in FIG. 1, preferably metal, are connected to the top surface 40L with screws or other connectors. Said strips provide longitudinal reinforcement for said section. The trailing edge 59 of the front section curves upward and then flattens as it forms the upper surface of a mating cavity 45L; said mating cavity is a receptacle for block 60L of the connection assembly 55.

Front Section: Bottom Surface.

Figure 3:
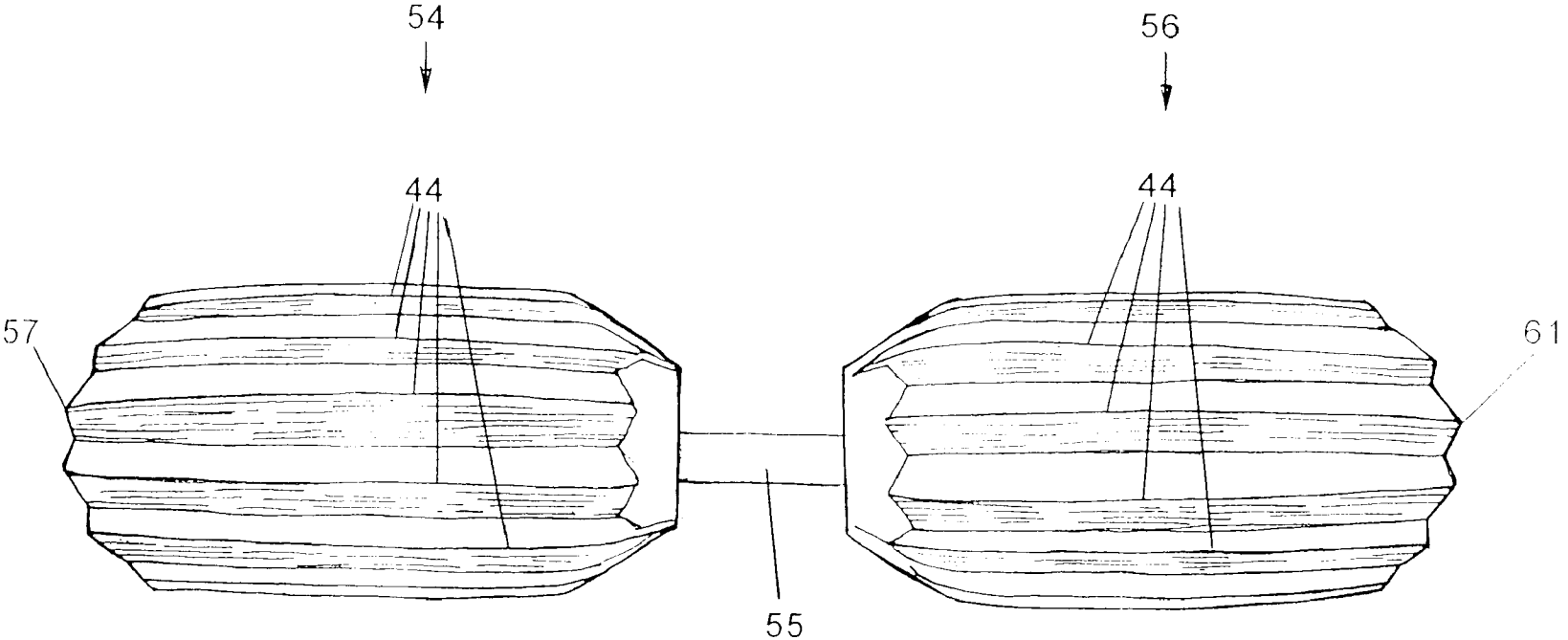
FIG. 3 is a bottom view towards the bottom surface thereof.

The bottom surface 42L of the invention is best shown in FIG. 3. Ridges 44 extend longitudinally along the bottom surface. The triangular shape of the ridges 44 are shown in cross-sectional view in FIG. 8. (To better describe the shape of the ridges: if one were to extrude a triangle and place one of the flat surfaces of the three-sided extrusion against the bottom surface of the section, running lengthwise, one would then have a ridge.) The number of ridges can be varied in order to modify the performance characteristics of the invention.

In addition, the ridges themselves can vary. An alternate embodiment of a ridge is depicted in FIG. 8, where a blade 115, made of metal or other hard material, protrudes from the bottom of one or more ridges to provide additional "bite" and improved control. Longitudinal blades facilitate movement in a direction parallel to the longitudinal axis of the section.

Figure 4:
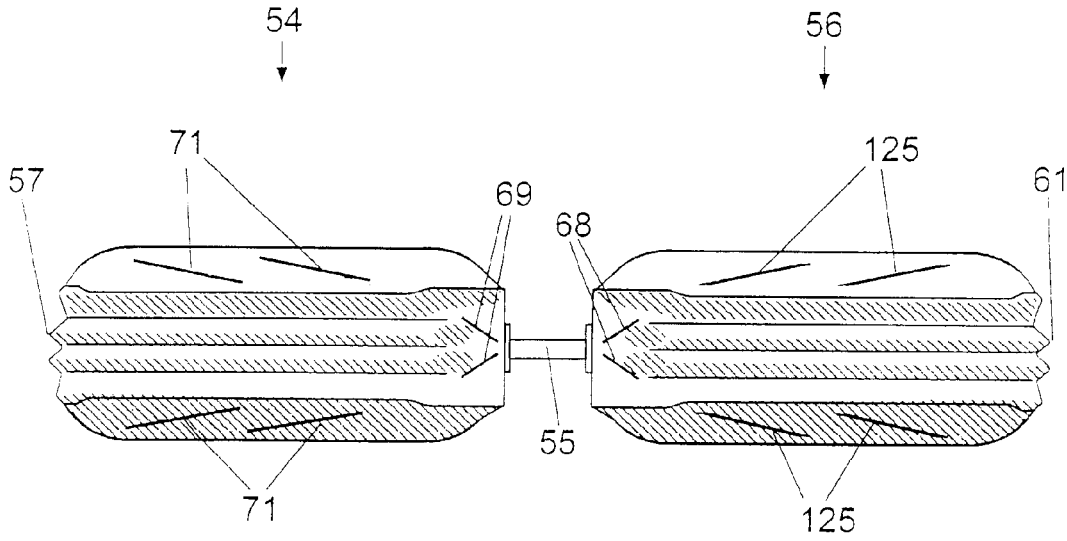
FIG. 4 is a bottom view illustrating turning blades thereof.
Figure 5:
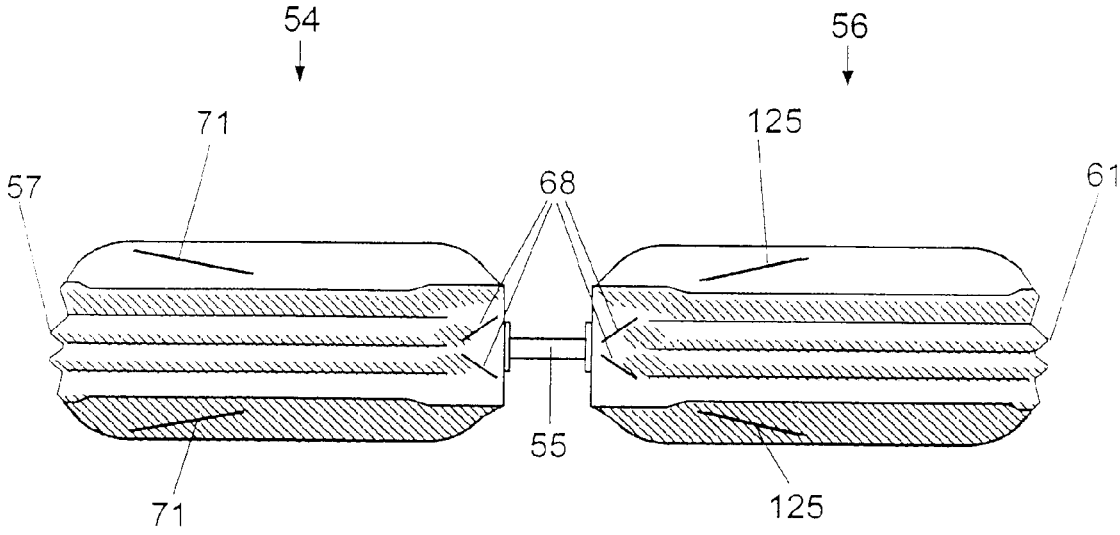
FIG. 5 is a bottom view illustrating turning blades thereof.
Figure 6:
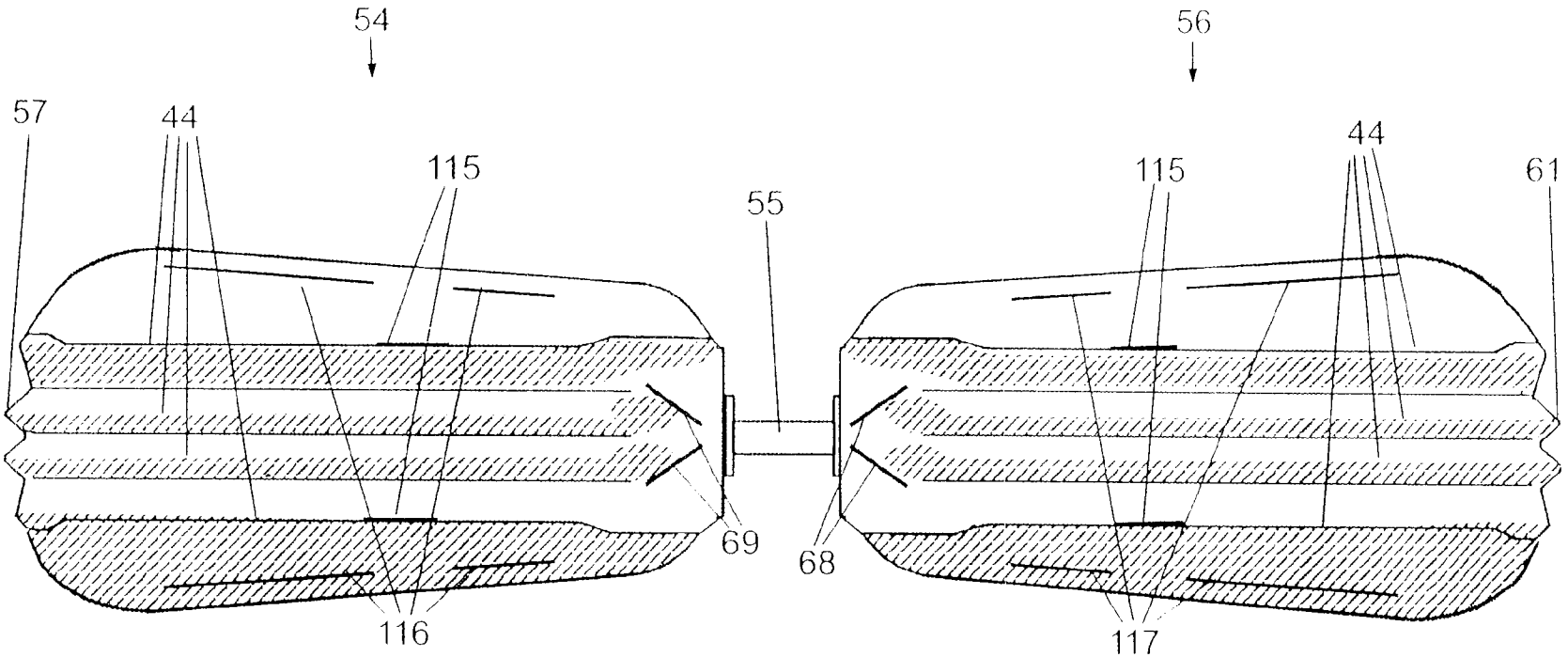
FIG. 6 is a bottom view illustrating a tapered shape thereof.

Blades may also be used to aid in turning and/or stopping, and are usually placed on the periphery of the sections. FIGS. 4, 5, and 6 illustrate placement of blades and ridges. FIG. 4 shows two sets of turning blades 71 and 67. Angled out blades 71 are pointed away from the longitudinal axis of the section to facilitate the turning of the front section in the direction of the turn. For example, the front section will turn right in a right-hand turn. Angled-in blades 67 on the rear section are pointed towards the longitudinal axis of the board so that the rear section will tend to turn in the direction away from the turn. For example, the rear section will tend to turn left in a right-hand turn, which places the invention in a curve to the right, and facilitates the turn. FIG. 4 also shows two sets of stopping blades. Angled-out stopping blades 69 have more stopping power than angled-in stopping blades 68.

FIG. 5 shows one right turning blade on each section and one left turning blade on each section, rather than the two blades per side per section, as shown in FIG. 4.

FIG. 6 depicts turning blades that are parallel to the sides of the sections, but since the sections are themselves slightly angled, this results in the blades 116 angled out and the blades 117 angled in, resulting in the functionality as the boards in FIGS. 4 and 5, with the additional advantage of the board shape working with the turning blades to further facilitate turns.

In all cases of ridges and blades, the convexness of the bottom surface perpendicular to the longitudinal axis combined with the ridges, including longitudinal, turning or stopping ridges, are some of the key differences between this invention and traditional snowboards or skis.

Front Section: Spacers.

Figure 7:
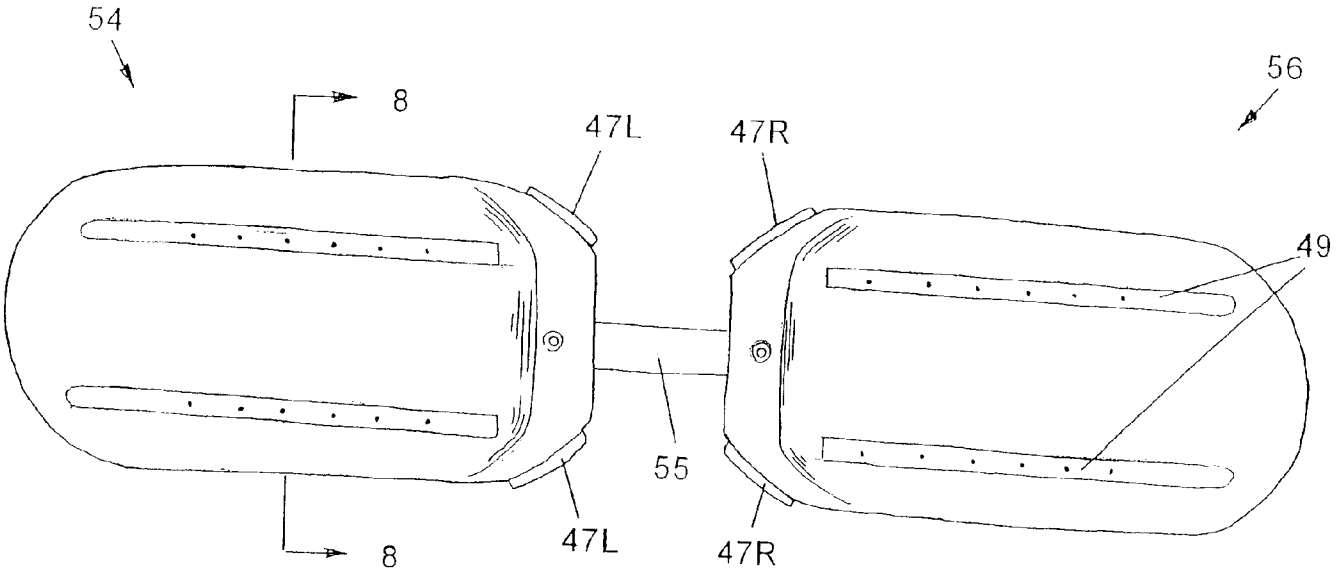
FIG. 7 is a top view thereof.

FIGS. 1 and 7 show bumpers or spacers 47L, located on the sides of the trailing edge of the front section. The spacers are preferably constructed of hard, resilient material such as a hard rubber or similar material.

Front Section: Internal Construction.

Figure 12:
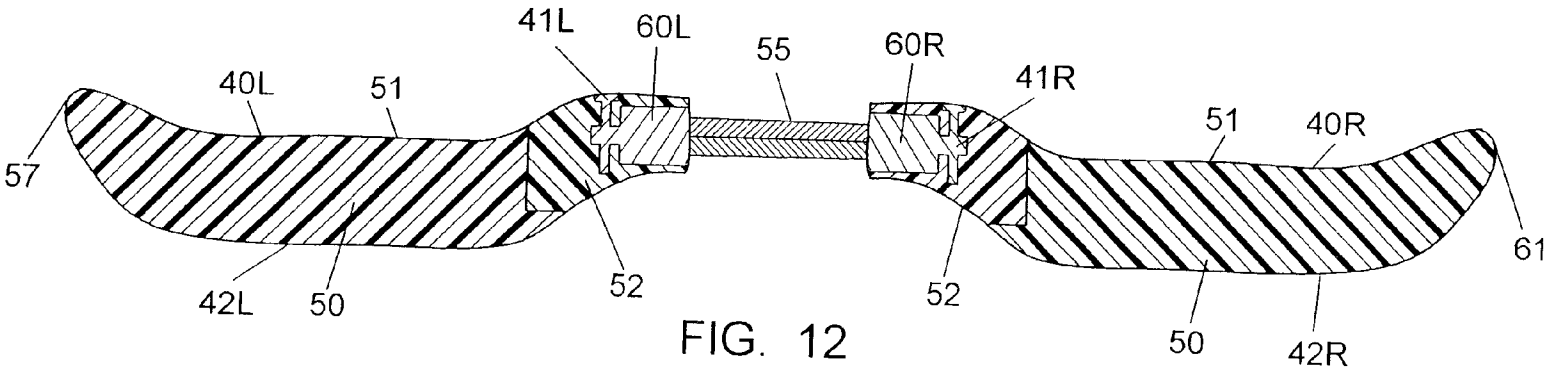
FIG. 12 is a cross-sectional view taken along line 12—12 of FIG. 11.
Figure 13:
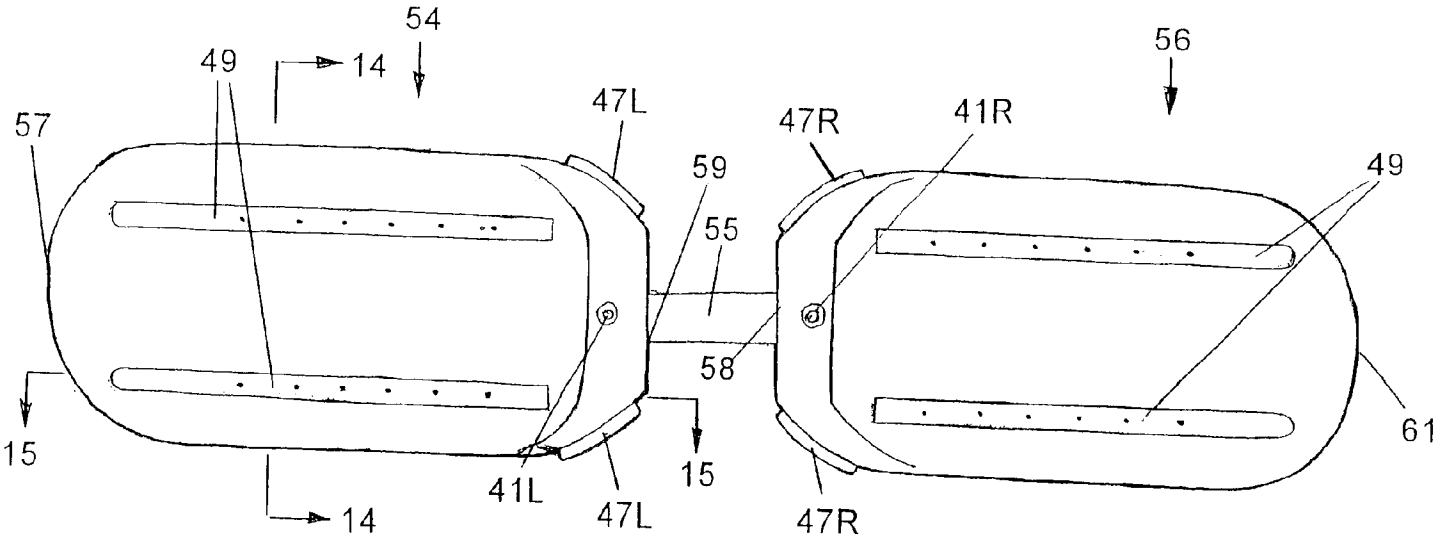
FIG. 13 is a plan view thereof.
Figure 15:
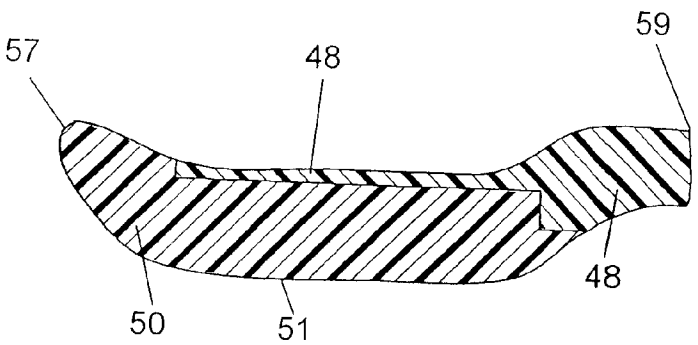
FIG. 15 is a cross-sectional view taken along line 15—15 of FIG. showing reinforced areas.
Figure 14:
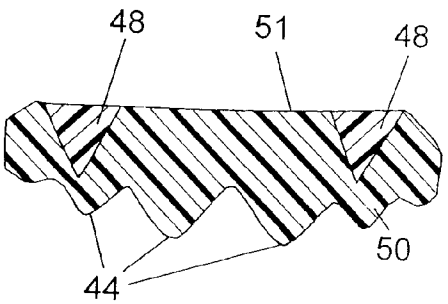
FIG. 14 is a cross-sectional view taken along line 14—14 of FIG. 13.

FIGS. 12, 14, and 15 illustrate the internal construction of the invention. The inner core 50 is surrounded by a durable outer layer 51. The inner core is preferably a carvable foam, but can be wood, composite or a similar material that helps to provide shape to the invention. The outer layer is preferably fiberglass resin and cloth, but can be any material that helps to provide a durable outer layer of adequate strength, such as an injection molded plastic, a composite, metal, carbon fiber, or any other similar material. Additional reinforcement for high stress areas may be desirable, depending on materials used. In the preferred embodiment, reinforcement material 52 is used in the trailing edge of the front section so as to reinforce the mating cavity which holds the connection assembly block. Reinforcement material is preferably a plastic that pours and molds into the desired shape, but can be any material that increases the strength and durability of the area, such as a high-strength plastic, composite, metal or any other similar material. A lengthwise band of the reinforcement material 48 is also used under strips 49, as shown in FIGS. 14 and 15.

Rear Section: Same as Front Section.

FIG. 1 shows the rear section 56 to be a mirror image of the front section. Therefore, the description above of the front section applies also to the rear section, except that the leading edge 57 of the front section is the trailing edge 61 of the rear section, and the trailing edge 59 of the front section is the leading edge 58 of the rear section. And the part numbers use "R" instead of "L" as a suffix.

Connection Assembly: Overview.

Figure 20:
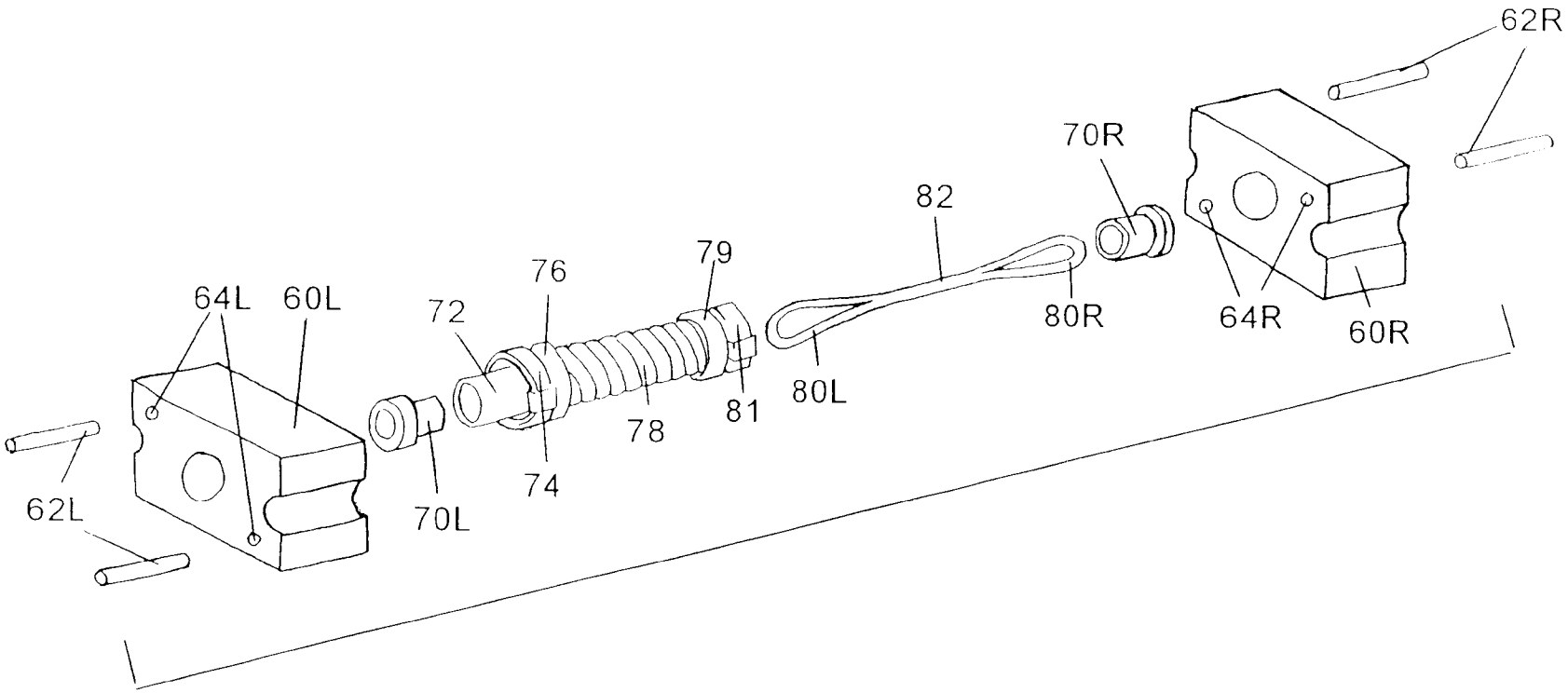
FIG. 20 is an exploded perspective view of the connection assembly thereof.

FIG. 20 illustrates the connection assembly. The connection assembly resists movement from its unstressed position. In addition, it is advantageous if it can be easily disconnected from the front and back sections for storage and replacement purposes.

Connection Assembly: The Innermost Cord Within the Tube.

In FIG. 20, a cord 82, preferably constructed of a strong, flexible material such as stranded cable, with loops 80L and 80R at each end, is inserted into a flexible tube 72. The tube is preferably filled with a flexible filler material 86, such as silicone. Flanges 70L and 70R are inserted into front end and back end of tube 72, respectively.

Connection Assembly: Spring, Clamps and Block.

The tube 72 is inserted into a spring 78. Circular clamps 74 and 76 are tightened around the front end of the spring. Circular clamps 79 and 81 are tightened around the rear end of the spring. Cord, tube, flexible filler, flanges, spring and circular clamps connect to form a spring assembly 65. The blocks 60L and 60R are preferably a moldable, rigid material, such as plastic or resin.

Connection Assembly: Spring Assembly an Integral Part of Block.

Figure 17:
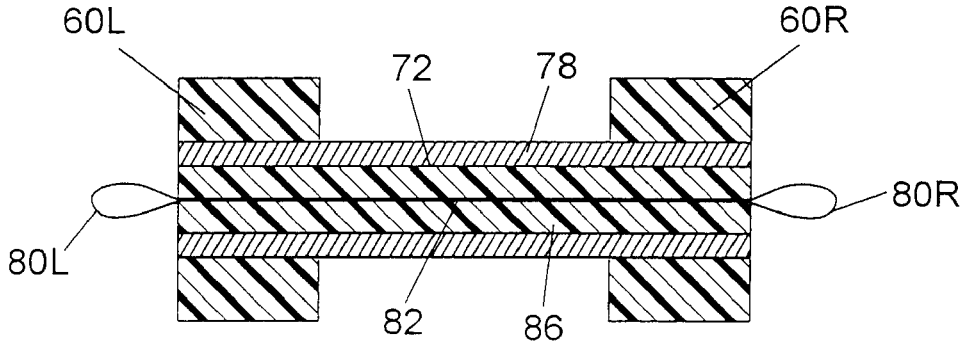
FIG. 17 is a longitudinal cross-sectional view taken along line 17—17 of FIG. 16.
Figure 18:
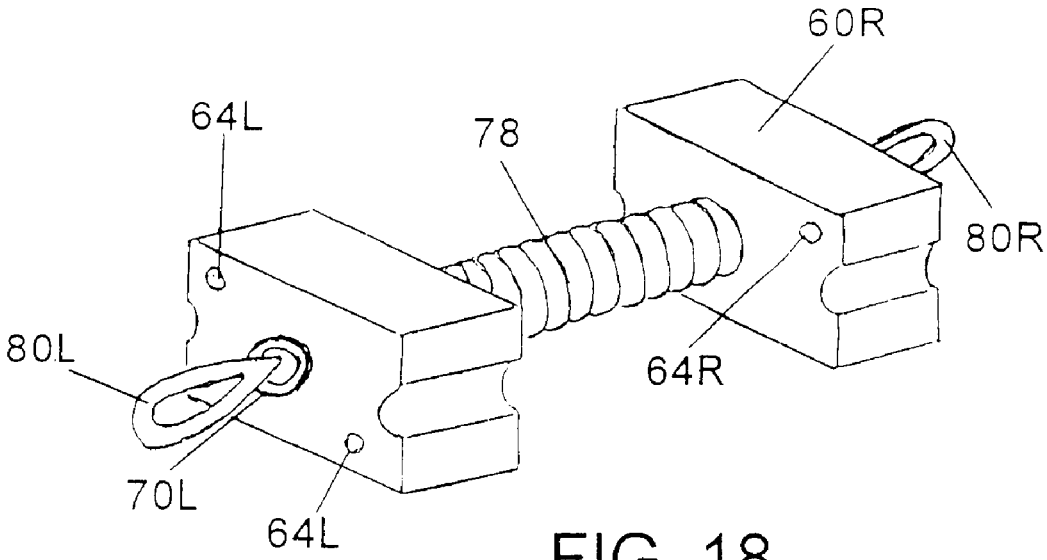
FIG. 18 is a perspective view of the connection assembly thereof.
Figure 19:
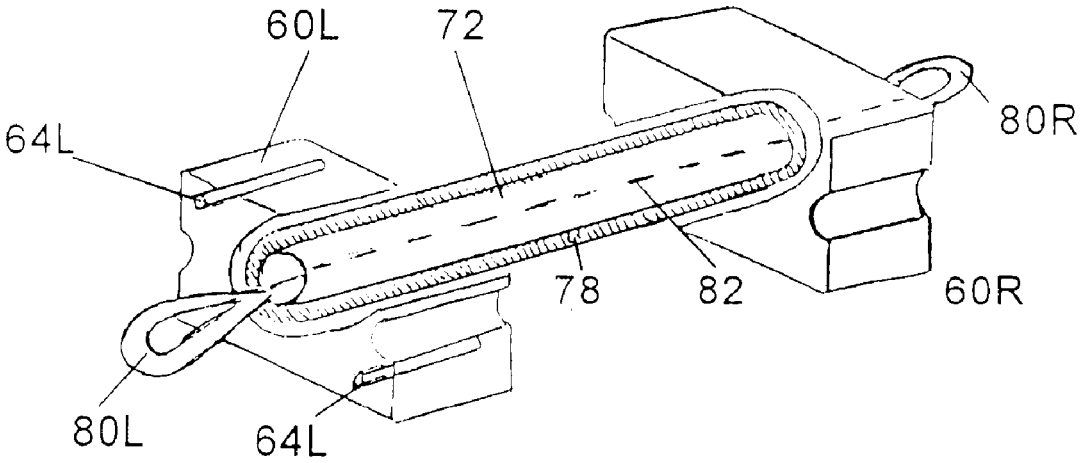
FIG. 19 is a cut-a-way perspective view of the connection assembly thereof.

The front end and rear end of the spring assembly are molded into block 60L and 60R, respectively. Making the spring assembly an integral part of the block anchors the spring assembly at each end and aims to prevent movement of the end of the spring in the direction of the coils, clockwise and counter-clockwise. The purpose of the circular clamps now becomes apparent—they provide asymmetrical projections within the block to help prevent the spring assembly from twisting and breaking loose inside the block. Tubes 62L insert in holes 64L to prevent damage to block 60L from over-tightening of bolts 43L (shown in FIG. 1). FIG. 18 illustrates the connection assembly. FIG. 19 is a cut-a-way of the connection assembly, showing the relationship of the spring assembly and block. FIG. 17 is a longitudinal cross-sectional view of the connection assembly.

Connection Assembly: Snow Barrier Covering on the Spring.

Figure 16:
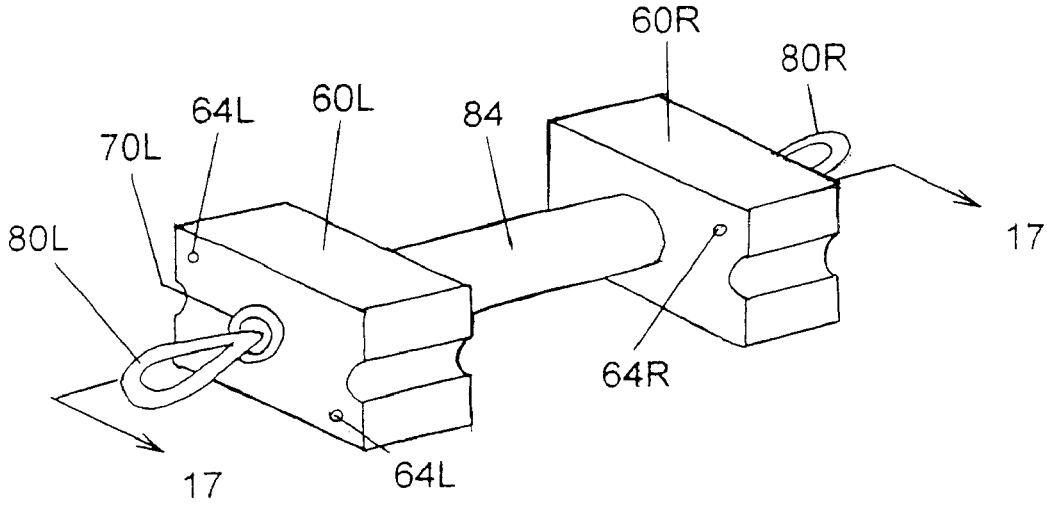
FIG. 16 is a perspective view of the connection assembly thereof, including the flexible sheath covering the spring.

FIG. 16 illustrates a covering 84 over the spring, which may be made of rubber or other barrier to prevent show from lodging between the coils of the spring.

Connection Assembly: Non-twistable.

Figure 21:
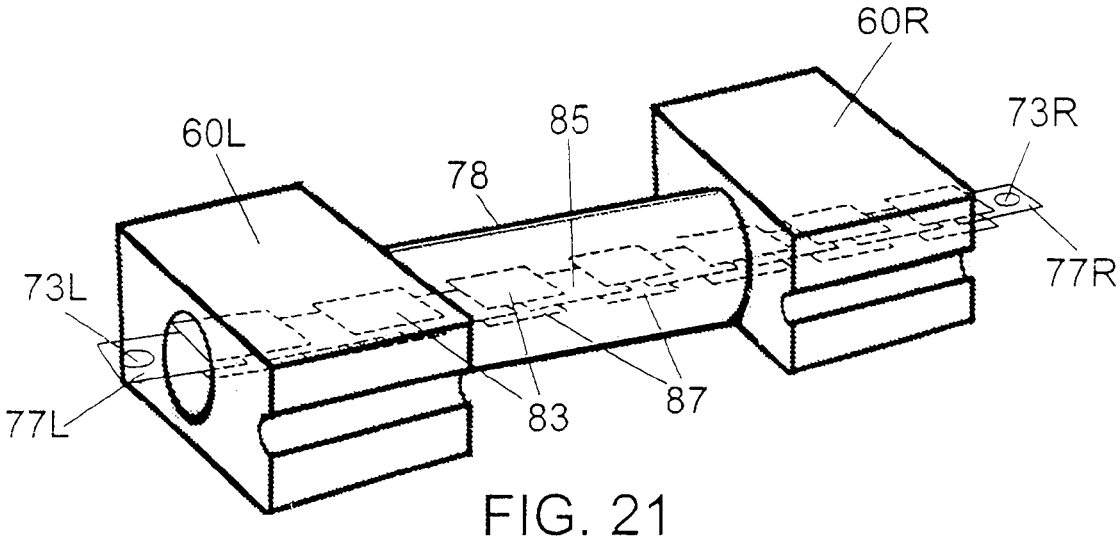
FIG. 21 is a perspective view of an alternate embodiment of the connection assembly thereof, suing plates in place of the center cord.
Figure 22:
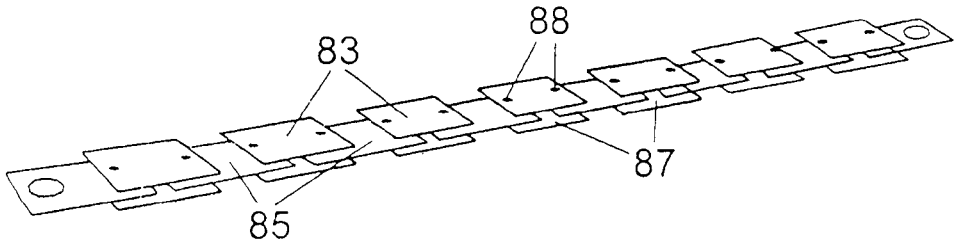
FIG. 22 is a perspective view of the plates of FIG. 21.
Figure 23:
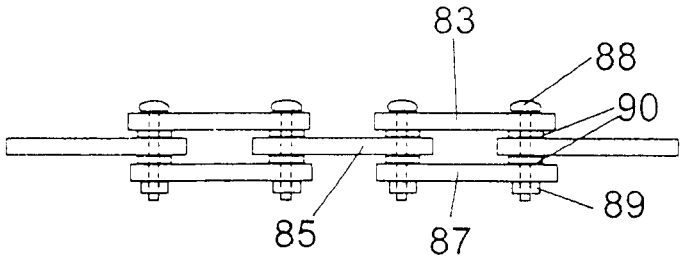
FIG. 23 is a fragmentary side view of the plates of FIG. 22.
Figure 24:
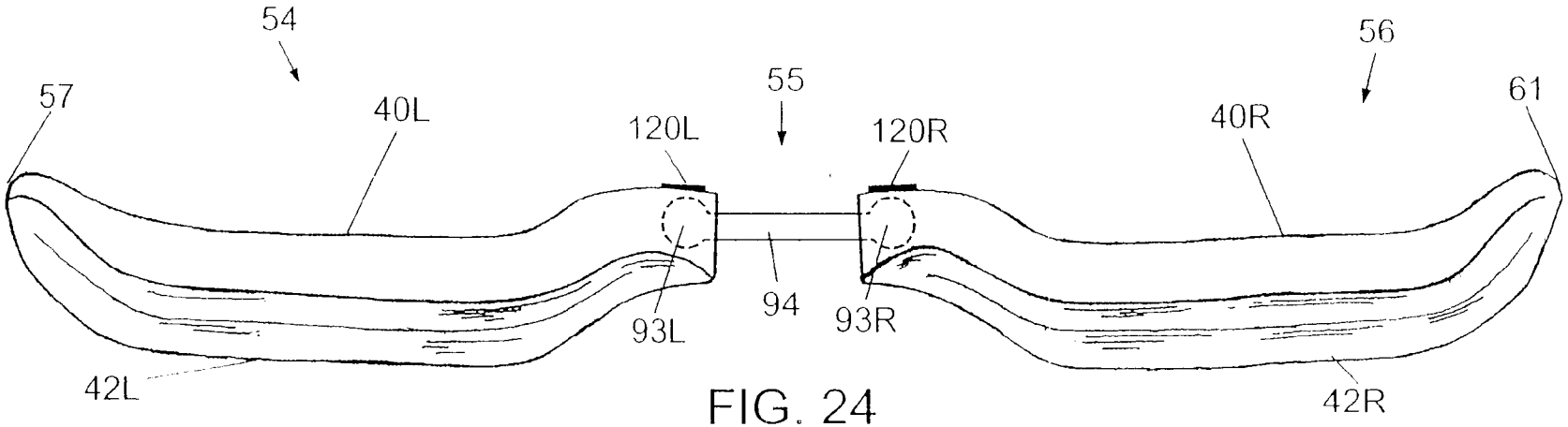
FIG. 24 is a side view of an alternate embodiment of the connection assembly thereof, using a ball and socket.
Figure 25:
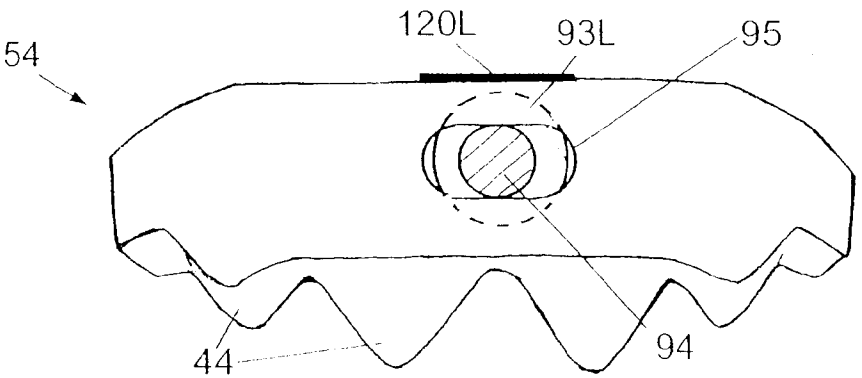
FIG. 25 is a rear side view of the front section of an alternative embodiment of the snowboard of FIG. 24.

FIGS. 21, 22, and 23 illustrate a non-twistable version of the connector. The cord 82 is replaced with a plate assembly, depicted in FIG. 22, comprised of preferably metal plates fastened with bolts. A bolt 88 passes through an upper plate 83, a washer 90, a middle plate 85, a washer 90, a lower plate 87, and nut 89, respectively. The plate assembly is positioned within the connector as shown in FIG. 21. When attaching the connector to the front and back sections of the invention, the blocks 60L and 60R are inserted in the receptacles 45L and 45R, and the bolts 41L and 41R are inserted through a hole 73 of the connector and secured to the respective section.

Connection Assembly: Rigid Connector, Ball and Socket Joint.

Figure 26:
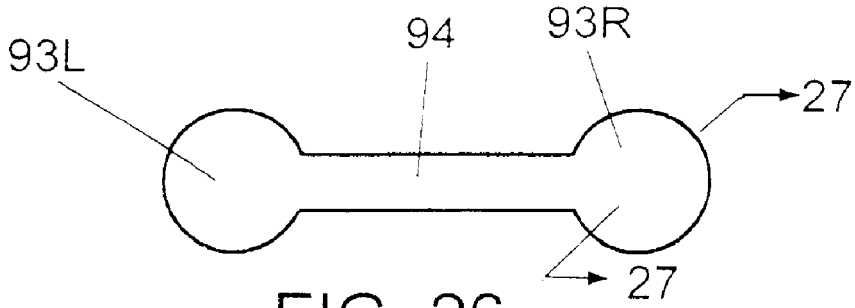
FIG. 26 is a side view of the connector of the snowboard of FIG. 24.
Figure 27:
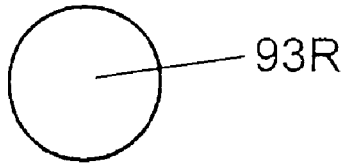
FIG. 27 is a sectional view taken along line 27—27 of FIG. 26.
Figure 28:
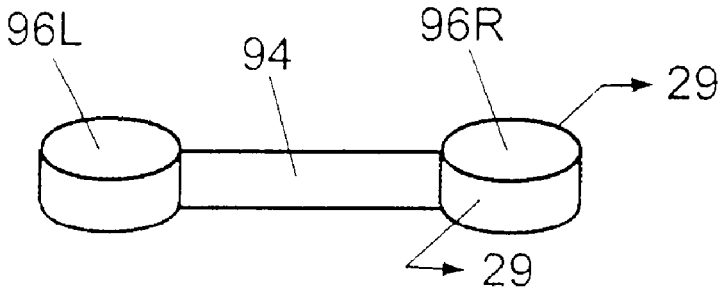
FIG. 28 is a side view of an alternate embodiment of the snowboard of FIG. 26.
Figure 29:
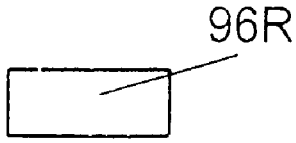
FIG. 29 is a cross-sectional view taken along line 29—29 of FIG. 28.

FIGS. 24, 25, 26, and 27 illustrate a ball and socket joint that will provide motion in all directions with a rigid connector. The connector is a rod 94, preferably metal, with spheres 93L and 93R at each end, as shown in FIG. 26. A horizontal slot 95 allows the rod 94 to swing left to right, horizontally. The spheres allow the sections to twist around their longitudinal axis. The spheres 93L and 93R are held securely within each section with a door 120. Vertical motion could be added by including a vertical slot. Or full range motion could be implemented with a funnel-shaped hole, with the sphere at the narrow end and the rod having the.wide end of the funnel to move freely. FIGS. 28 and 29 illustrate a rigid connector for the ball and socket joint that would prevent twisting and would only allow movement in the horizontal plane. The spheres are flattened into discs 96L and 96R so that they will not move up and down, but only horizontally.

Figure 30A:
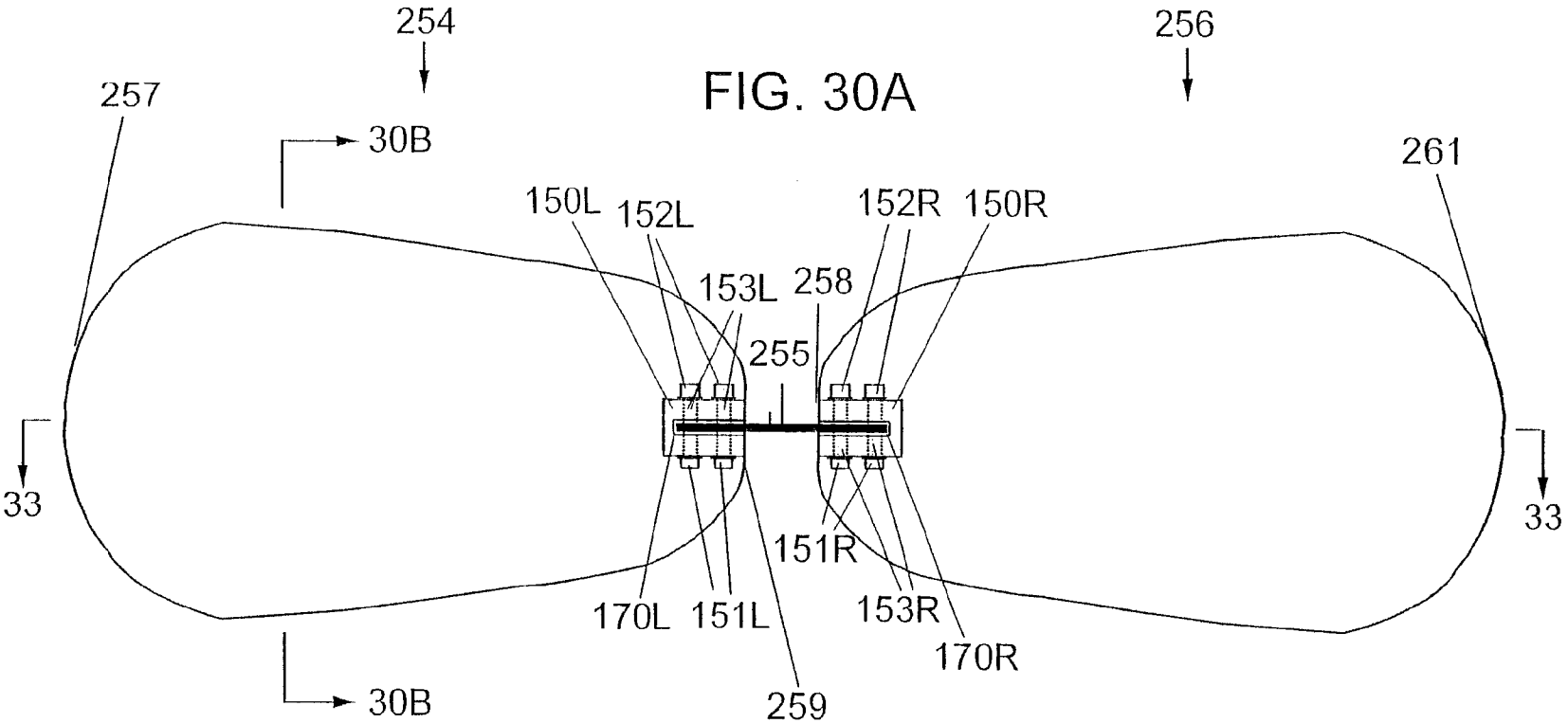
FIG. 30A is a top view of the present invention.
Figure 35A:
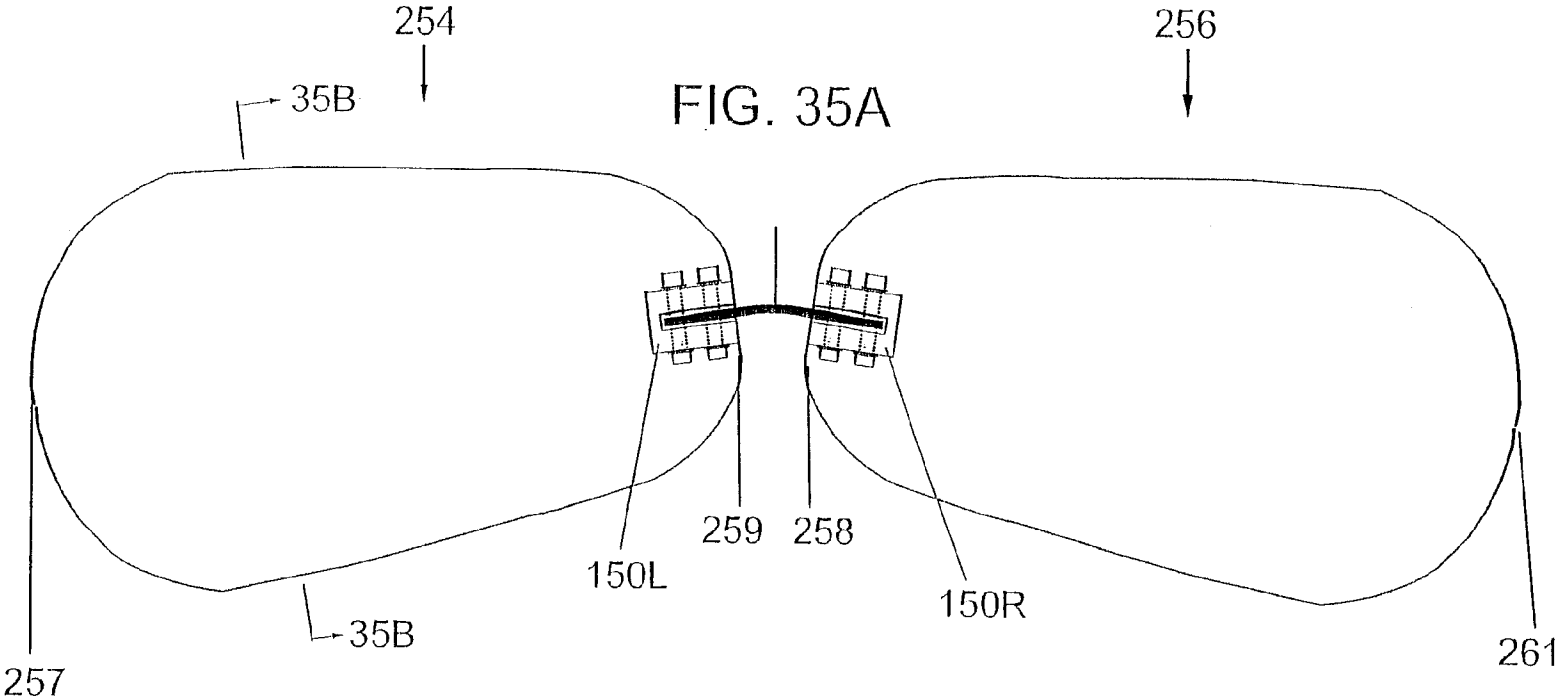
FIG. 35A is a plan view of the present invention as it would appear in a turn.

A preferred embodiment of the present invention, as best shown in FIG. 30A, comprises a front section 254 and a rear section 256 joined with a stiff but elastically bendable connector 255. Although front section 254 and rear section 256 are depicted as identical, they may differ in size, shape or construction to alter the performance characteristics of the invention. The rider of the invention will place one foot on section 254 and one foot on section 256, preferably with feet at angles to the longitudinal axis in a stance similar to that used by traditional snowboarders. A "stiff but elastically bendable" means a connector fabricated from a material such as spring steel. Other materials, such as polymeric materials of ultra high molecular weight polyethylene, polypropylene, and including composite polymers, can be used. The important quality is that of providing a stiff connection and yet, one that will bend with sufficient force. A typical connector stiffness is illustrated in FIG. 35A. A weight W of ten pounds is applied normal to the longitudinal axis of rear section 256 a distance D1 of ten inches behind trailing edge 259 of front section 254. This causes a bending of connector 255. The amount of deflection D2 measured 21.6 inches behind trailing edge 259 was 2.6 inches. This, of course, is just an example of a practical stiffness and it is possible to change this stiffness substantially and provide more deflection for a younger rider and less deflection for a heavier adult rider.

Connection of the Three Primary Parts of the Invention: Front Section, Rear Section and Connector.

Figure 34:
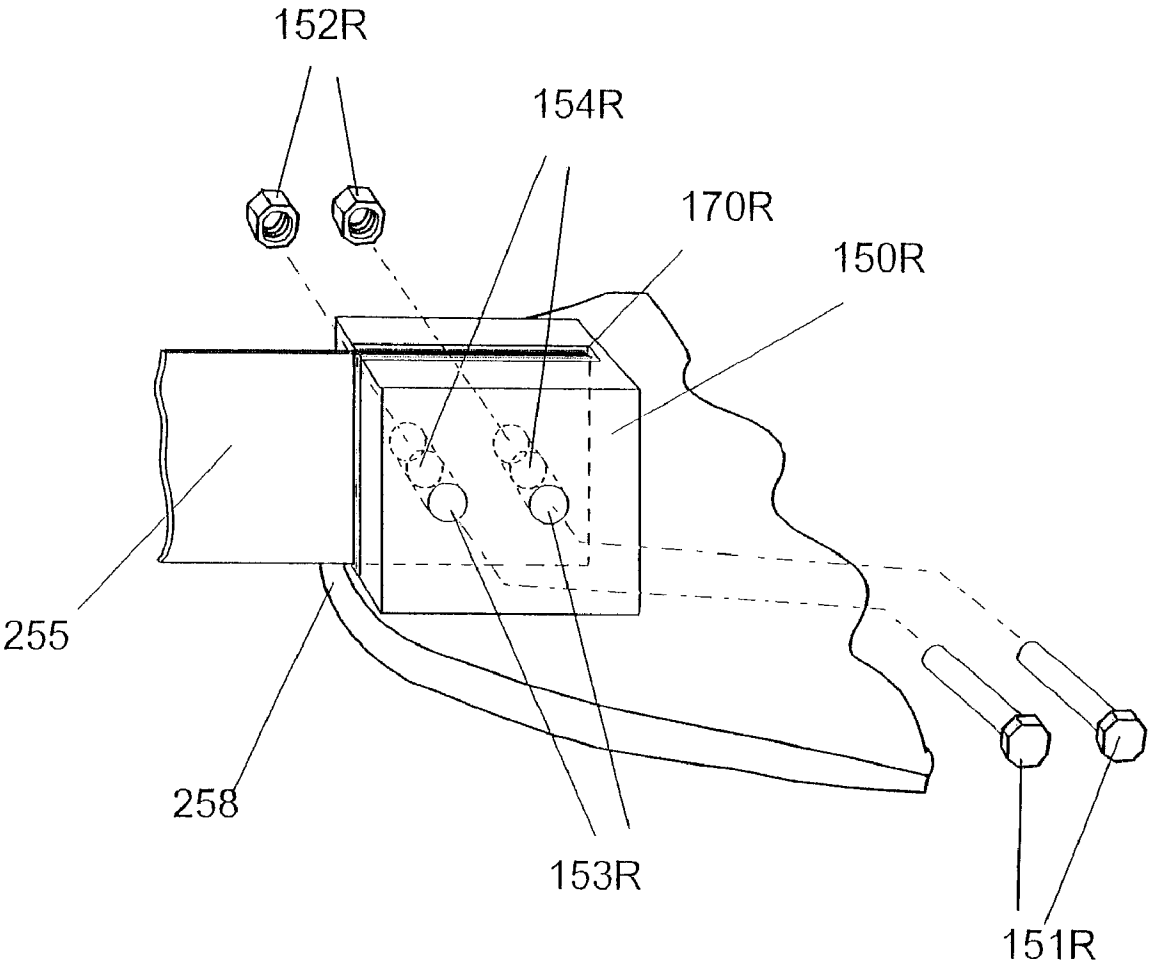
FIG. 34 is a perspective fragmentary view of attachment of connector to rear section.

FIG. 30A and FIG. 34 illustrate how the three primary pieces of the invention, the front section, the rear section, and the connector is inserted into a channel, slot, or cavity 170L in an open housing or block 150L. Locking pins or bolts 151L are inserted into holes 153L and secured with nuts 152L. Locking pins 151L secure the connector to the front section. To connect the rear section to the connector, the connector is inserted into a channel, slot, or cavity 170R in an open housing or block 150R. Locking pins or bolts 151R are inserted into holes 153R. Locking pins or bolts 151R secure the connector to the rear section.

Front Section: Shape and Outer Surface.

The front section has a somewhat convex bottom. The bottom surface of the section is not only convex parallel to the longitudinal axis as shown in FIG. 31, it is also preferably convex perpendicular to the longitudinal axis, as shown in cross-sectional view FIG. 30B. This would usually mean that the lowest area, ridges 180L of the bottom surface, are lower than the outside edges 182L of the bottom surface. The leading edge 257 in FIG. 31 is curved upward somewhat. The trailing edge 259 of the front section also curves upward.

Front Section: Bottom Surface.

Figure 32:
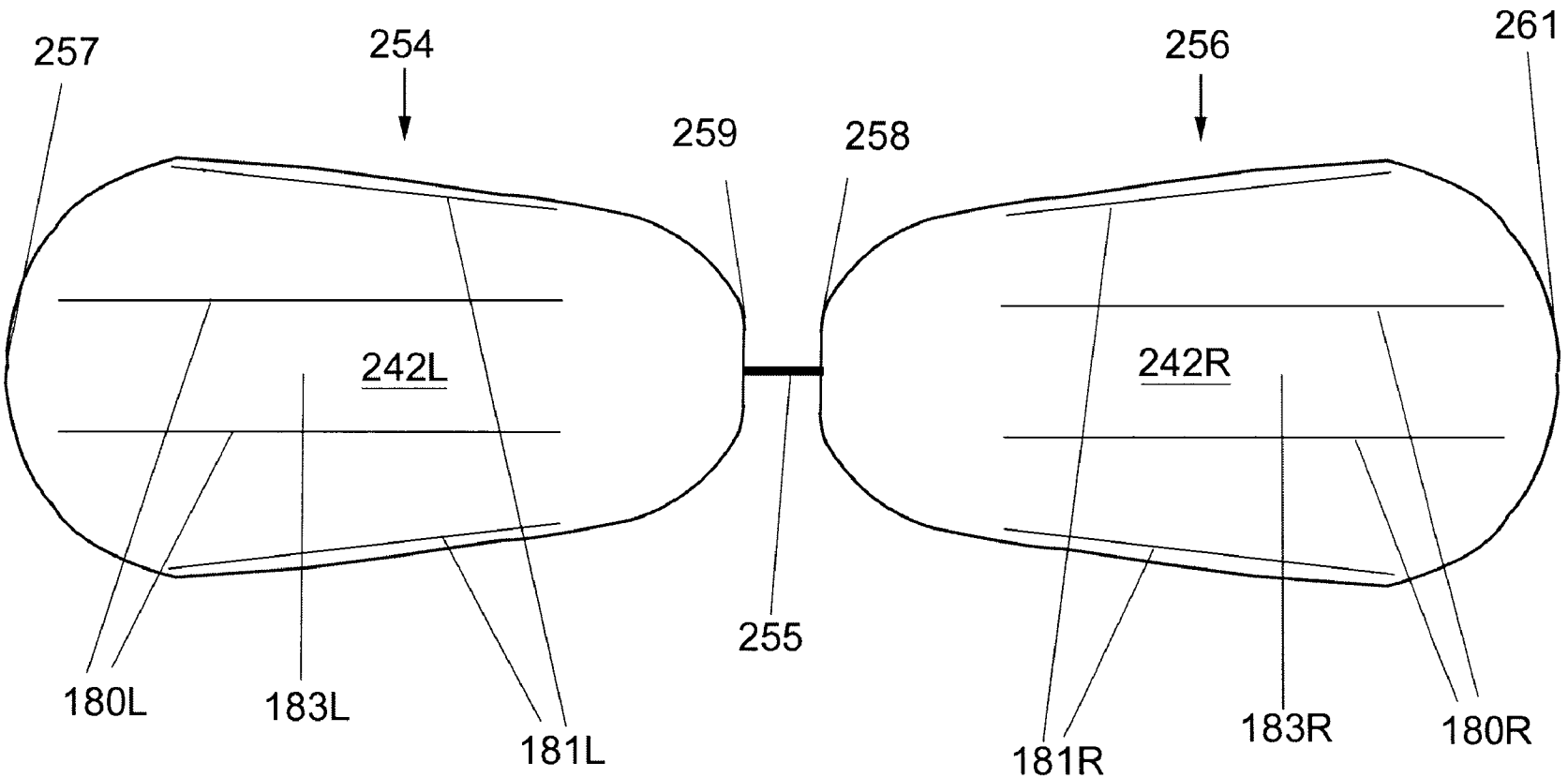
FIG. 32 is a bottom view illustrating the placement of ridges of the snowboard of FIG. 30A.

The bottom surface 242L of the invention is best shown in FIG. 32. Ridges or protrusions 180L and 181L extend somewhat longitudinally along the bottom surface. The centermost ridges 180L are approximately parallel to the longitudinal axis. The outside ridges 181L are slightly angled; when facing towards the front of the board, the forward end of the ridges on the left side of the front section are angled towards the left and the forward end of the ridges on the right side of the front section are angled towards the right. When the section is tipped onto its side by the rider, these ridges are engaged and cause the board to turn more tightly.

Front Section: Bottom Platform Width.

Figure 30B:
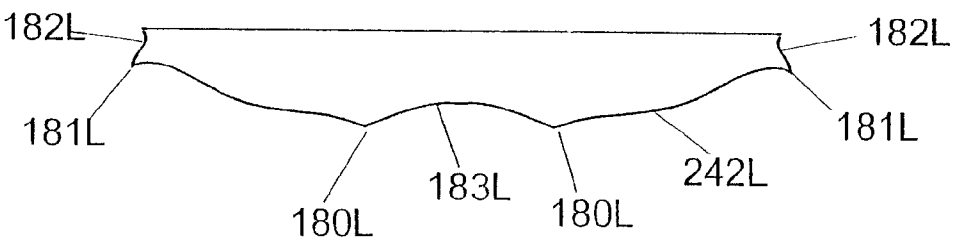
FIG. 30B us a cross-sectional view taken along line 30B—30B of FIG. 30A.
Figure 31:
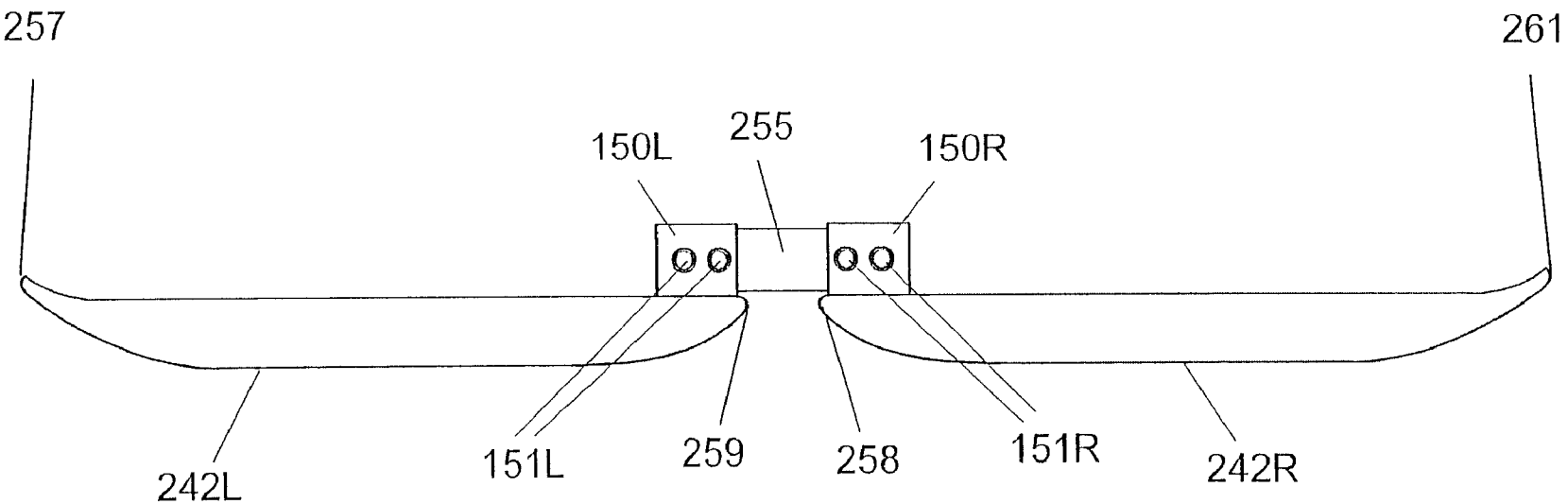
FIG. 31 is a side view of the snowboard of FIG. 30A.

Longitudinal center ridges 180L in FIG. 30B are the two lowest points on the bottom of the front section. They are, therefore, in contact with the snow, creating a platform on which the rider balances the section. The distance between the two center ridges 180L is approximately 3 inches. A front section with a distance between the two center ridges 180L of less than 3 inches will tip more easily from one side to the other, and will be less stable, making it more difficult to maintain a consistent side-to-side position. A front section with a distance between ridges 180 greater than 3 inches will be less likely to tip from side-to-side and will be more stable and easier to balance. The optimal platform width for a section will be determined by the size and shape of the section, as well as number and placement of ridges on the bottom of the section.

Front Section: Internal Construction

Figure 33:
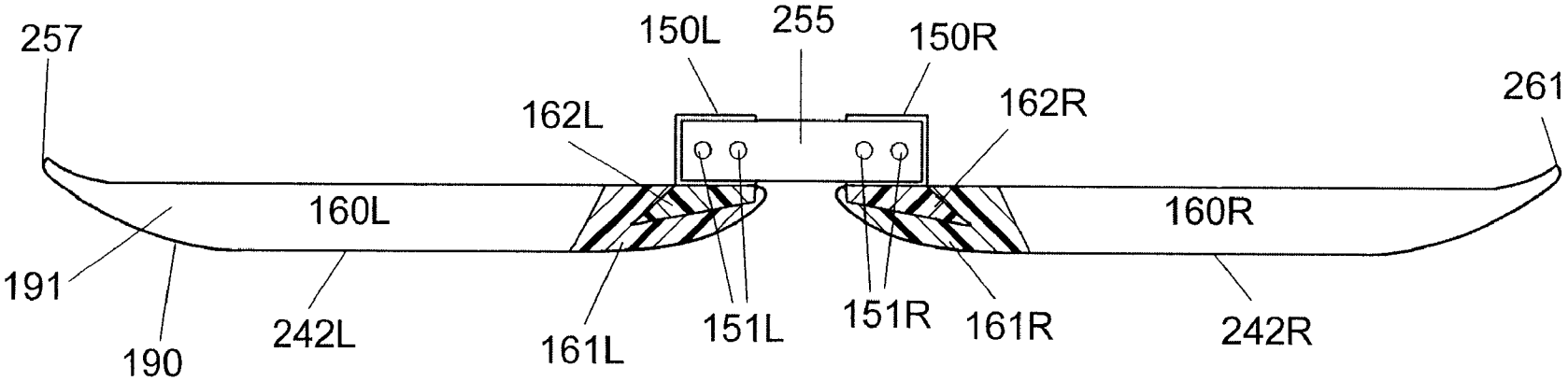
FIG. 33 is a cross-sectional view of the present invention taken along line 33—33 of FIG. 30A.

FIG. 33 illustrates the internal construction of the invention. The inner core 191 is surrounded by a durable outer layer 190 which has a right side 160L. The inner core is preferably a carvable form, but can be wood, composite or a similar material that helps to provide shape to the invention. The outer layer is preferably fiberglass resin and cloth, but can be any material that helps to provide a durable outer layer of adequate strength, such as an injection molded or rotationally cast plastic, a composite, a metal, carbon fiber, or any other similar material. Additional reinforcement for high stress areas may be desirable, depending on materials used. In the preferred embodiment, reinforcement material 161L is used in the trailing edge of the front section so as to reinforce the area around the embedded extension 162L of the block 150L. Reinforcement material is preferably a plastic that pours and molds into the desired shape, but can be any material that increases the strength and durability of the area, such as a high-strength plastic, composite, metal or any other similar material. If a section could be constructed with injection molded plastic or similar process, the carvable inner core and some other elements described herein may not be required.

FIG. 30 shows the rear section 256 to be a mirror image of the front section. Therefore, the description above of the front section applies also to the rear section, except that the leading edge 257 of the front section is the trailing edge 261 of the rear section, and the trailing edge 259 of the front section is the leading edge 258 of the rear section. And the part numbers use "R" instead of "L" as a suffix. The right side of the rear section is indicated by reference character 160R.

Connector: Overview.

FIGS. 33 and 34 illustrate how the connector is attached to each section. The connector consists of one or more strips of a semi-rigid, flexible material, such as metal, ultra high molecular weight plastic, or other material with similar characteristics, or a combination of one or more such materials. The important characteristics of the connector are: that it flex from side-to-side in the horizontal plane; that it be unable to flex up and down in the vertical plane; that it not be able to twist so as to provide a stable riding platform; that it be sufficiently strong; that it resist movement from its unstressed position; and that it return to its unstressed position if moved into a different position. The attachment of the connector is such that it can be easily disconnected from the front and back sections for storage and replacement purposes.

Connection Assembly: Details.

The connector is preferably one strip of metal, or a side-by-side sandwich of two or more strips of metal. It may also include strips of other materials such as plastic or rubber in the sandwich. The resulting connector must be strong enough to resist flexing, but still be able to be flexed on demand by the movement of the rider's feet. FIG. 34 illustrates the attachment of the connector to the rear section. The front section will be the same, except for the numbering of the various items—the front section numbers end in "L" instead of "R". Block 15OR is open on two sides—the side facing the connector and the side facing the top. The end of connector 255 slides into channel 170R. Holes 154R in the connector line up with holes 153R in the block. Locking pins or bolts 151R are placed in holes 153R and secured with nuts 152R.

Operation of Preferred Embodiment; Turning the Invention.

Figure 35B:
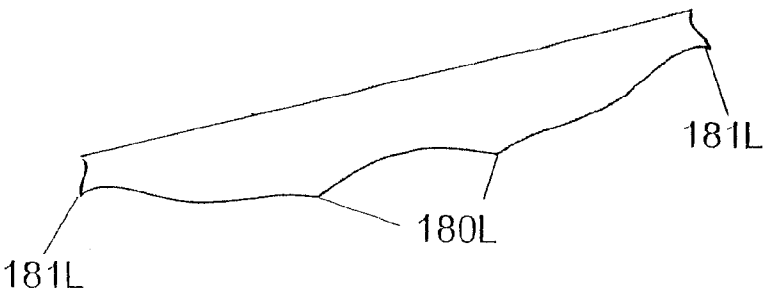
FIG. 35B is a cross-sectional view taken along line 35B—35B of FIG. 35A.

A rider will place one foot on the front section of the invention and one foot on the rear section. The rider will preferably have both feet secured to the respective sections. Traveling downhill over the snow, the rider can pivot his feet to point to the left or to the right, causing the board to pivot in the same direction. When the rider pivots his front foot to point to the right, the front section will turn to the right, which causes the entire board to turn to the right. When the rider pivots his front foot to point to the left, the front section will turn to the left, which causes the entire board to turn to the left. This turning tendency can be increased by placing ridges on the periphery of the sections at an angle to the longitudinal axis of the section, enabling the rider to further change his direction of travel by tilting the front or rear section about its longitudinal axis by shifting his weight left or right. When the rider's weight is shifted left, for example, that section's left side will tilt down as depicted in FIG. 35A and FIG. 35B, engaging ridges or blades that are angled to the left, and increasing the tendency of the section to turn left. Similarly, when the section is tilted down on the right, blades or ridges that are angled to the right will made contact with the surface, increasing the tendency of the section to turn right.

Stability.

The connector, when flexed, exerts a force against the flexion in an attempt to return to its unflexed state. This gives the invention a predictable stability. The sections will tend to stay in a straight line (an unflexed position), as illustrated in FIG. 30A, unless the rider proactively moves them out of the straight, unflexed position, as depicted, for example, in FIGS. 35A and 35B, as a turn to the left.

Ease of Connecting/Disconnecting Sections.

It is desirable to be able to easily connect and disconnect the sections. To this end, the connector is secured to each section with only two pins or bolts, easily removed by the rider. In an alternative embodiment for commercial production and use, the connector end can be dropped into a receptacle and secured with a hinged latch without the use of bolts to make it easier for the user to connect and disconnect.

Interchangeable Connectors.

The performance characteristics of the invention can be modified by using connectors with different flex characteristics. The lighter weight rider and the beginning rider might prefer a connector that is easier to flex, since the sections would be easier to maneuver. In addition, connectors can be varying lengths to accommodate the stride of different sized riders.

Interchangeable Sections.

Because invention performance can be modified by changing the characteristics of the front and rear sections, a rider may prefer one set of characteristics for the front section and another set of characteristics for the rear section. The rider can easily replace a front or rear section with a front or rear section having different characteristics. In fact, because the connection between front and rear sections may be identical and interchangeable, a rider can use a rear section from one sample of the invention as a front section, or a front section to replace a rear section in another sample of the invention.

Modifications to Section Bottom That May Change Performance.

Some of the characteristics of the invention that can be modified in order to change performance of the invention include: changing size, shape, contour, and number of ridges on the front and/or rear sections; changing the convexness of the bottom of the front or rear section; changing the length of a section; making ridges deeper or more shallow; modifying ridges with undulations on the ridges or ridges on the ridges. The sections may be identical mirror images as described in the preferred embodiment, or they may differ in shape and/or size.

Alternate Embodiments of Board Shape as Viewed from Above.

FIG. 32 illustrates the board shape as viewed from the bottom, approximating an oval shape, except that the inside curve is more pointed than the outside curve. Alternate embodiments of the board shape may have the outline shape of either the leading or trailing half of the section as different than depicted.

Alternate Embodiment of Lateral Cross Section.

FIG. 30B illustrates a cross-section of the preferred embodiment of the invention. An alternate embodiment of the board has a smaller or greater distance between the top surface and the bottom surface of a section.

FIGS. 37A, 37B, 37C, and 37D illustrate alternate embodiments of various bottom shapes and ridge placements.

Alternate Embodiments of Bottom Surface.

Ridge Placement.

Figure 36A:
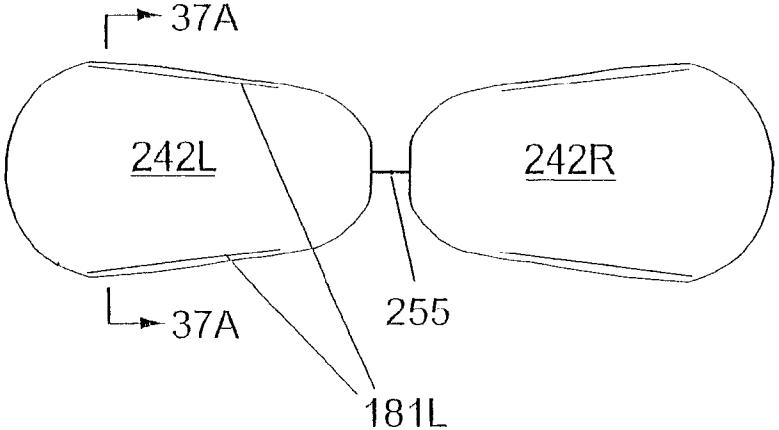
FIG. 36A is a bottom view of an alternative embodiment illustrating placement of two ridges towards the outer edge of the bottom of each section.
Figure 36B:
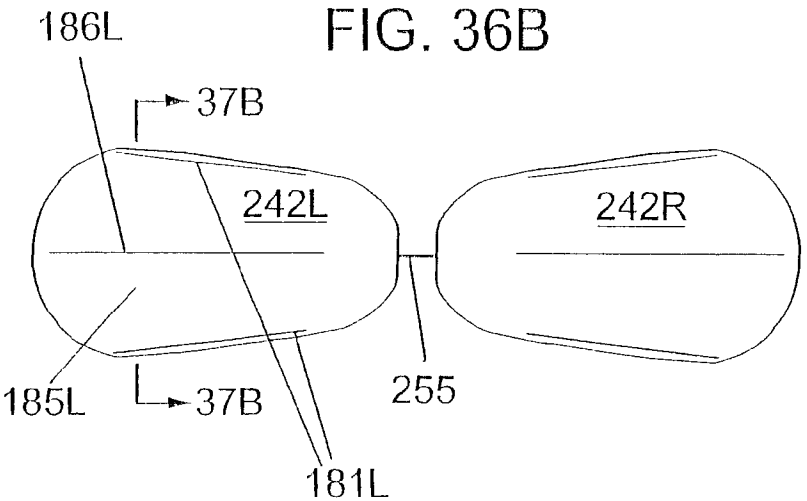
FIG. 36B is a bottom view of an alternate embodiment illustrating placement of two ridges towards the outer edge and a single ridge in the center of the bottom of each section.
Figure 36C:
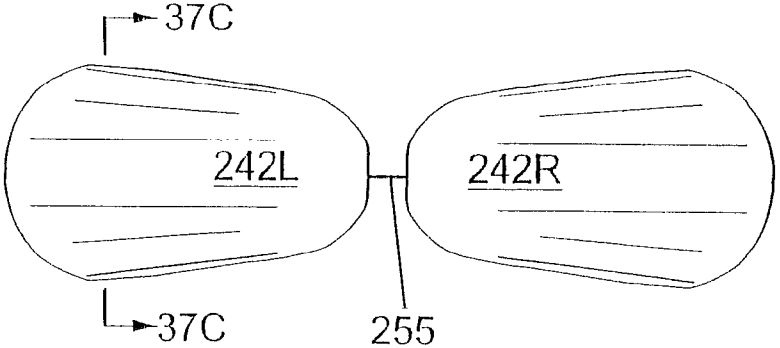
FIG. 36C is a bottom view of an alternate embodiment illustrating placement of six ridges on the bottom of each section.
Figure 36D:
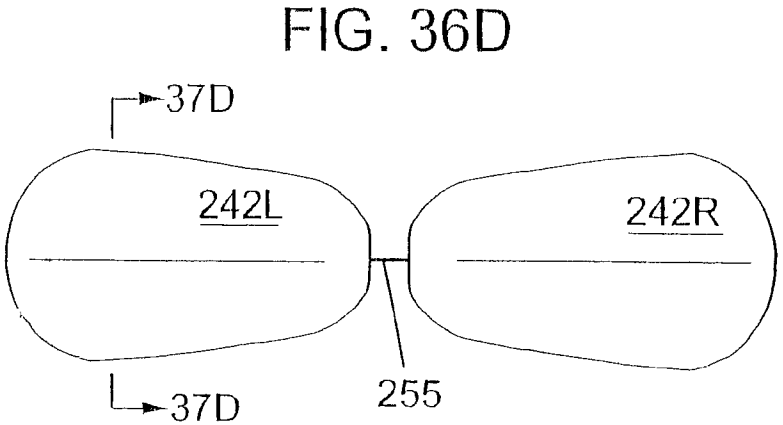
FIG. 36D is a bottom view of an alternate embodiment illustrating placement of one ridge on the bottom of each section.

A single ridge 187L may run longitudinally down the flat surface 188L of the bottom of the board as in FIG. 36D; the bottom of the board may have only outer ridges in flat surface 184L as depicted in FIG. 36A; the bottom of the board may have one central ridge and two outer ridges, as in FIG. 36B; the bottom of the board may have multiple sets of ridges as in FIG. 36C.

Number of Ridges.

As indicated, the bottom surface can have one or more ridges.

Depth of Ridges.

The ridges can vary in depth, which is defined as the distance from the bottom-most edge to the uppermost point of the ridge. Described another way, looking at the cross-section "V" shape of a ridge, the depth would be measured from the bottom of the "V" to the top of the "V".

Partial Ridge Coverage Longitudinally.

The ridges may extend the entire length of the board, from front to back, or they may extend over only a portion of the lengthwise distance. For example, a ridge could be only half the length of the board, starting from ¼ back from the leading edge and extending to ¾ back from the leading edge. Or a 2 inch ridge could be located close to the leading edge and another 3 inch ridge could be located back by the trailing edge.

Ridge Construction.

The ridges can be made of a material similar to the rest of the invention, or one or more ridges can consist of another material, or be constructed of multiple materials. Although the ridges would typically be constructed of a hard material, they may also be constructed of a flexible material. Ridges may have sharper, better-cutting edges by incorporation of a vertical blade made of metal or similar material.

Cross-Sectional Shape of Ridges.

The cross-sectional shape of the ridges as described in the preferred embodiment is triangular for the outer ridges and somewhat oval for the inner ridges. These shapes could be some other shape such as trapezoidal, rectangular, or curved (such as convex or concave-sided triangle or other polygon).

Angle of Protrusion of Ridges.

The angle of protrusion of the ridges in relationship to the tangent at the surface from which the ridges are protruding may be other than the preferred embodiment, which is perpendicular.

Ridges Placed on the Board for the Purpose of Turning.

Ridges may be used for turning. Ridges used for turning will preferably be placed on the periphery of a section and may vary in size, length, quantity, placement and construction.

Ridges Placed on the Board for the Purpose of Slowing or Stopping.

Ridges may be used for slowing and/or stopping. Ridges designed to slow or stop the board would preferably be placed in opposing pairs (one ridge turned to the left and one to the right), or as one or more ridges placed approximately perpendicular to the longitudinal axis of the section. They could be located on the periphery of the board, so that when the rider pushed the periphery down to engage the surface, the ridges would slow or stop the board. They could also be located elsewhere on the board and designed to drop down and engage when the rider's foot pressed an engagement mechanism.

Ridges Summarized.

In summary, ridges can be combined in a variety of ways, including varying uses, quantities, depths, lengths, angle, sharpness, shapes, location on board, construction, and composition.

Other Bottom Surface Additions for the Purpose of Increasing Friction.

A shape or material other than ridges can also be added to the bottom surface to increase friction under certain situations. This could be desirable, for example, on the far right or left side of the undersurface of the board, so that when that side of the board is tilted down, the friction on the side is increased, increasing drag and aiding in the turn towards that side. It may also be placed on the front or back of a section to improve braking action.

Removably Secured Bottom Surface Ridges or Additions.

Ridges or bottom surface additions may be designed to be removable and/or changeable to allow users to customize the bottom surface of each section. For example, ridges set at a greater angle from the longitudinal axis would provide a rider with more extreme turning capabilities.

Bottom Platform Variations.

Figure 37A:
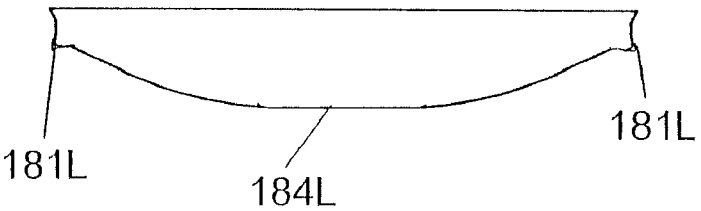
FIG. 37A is a cross-sectional view taken along line 37A—37A of FIG. 36A.
Figure 37B:
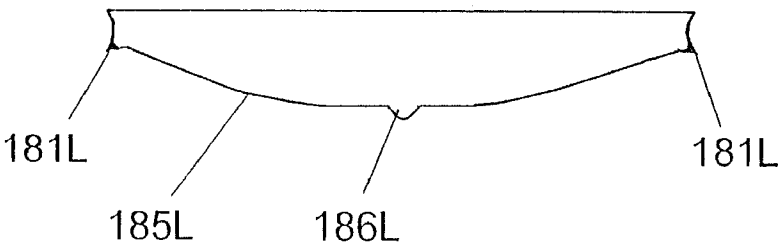
FIG. 37B is a cross-sectional view taken along line 37B—37B of FIG. 36B.
Figure 37C:
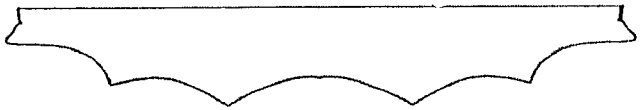
FIG. 37C is a cross-sectional view taken along line 37C—37C of FIG. 36C.
Figure 37D:
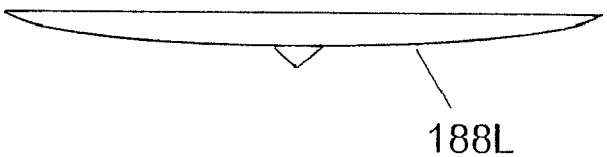
FIG. 37D is a cross-sectional view taken along line 37D—37D of FIG. 36D.
Figure 38C:
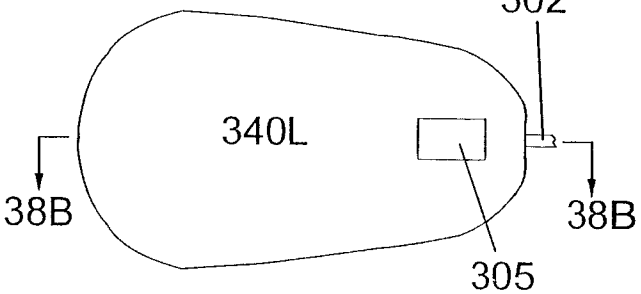
FIG. 38C is a top plan view of the alternative embodiment of the connection of FIG. 38A.
Figure 38B:
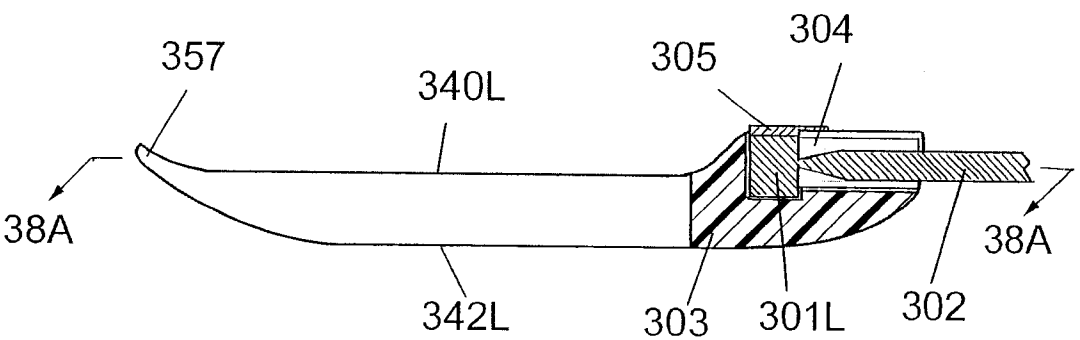
FIG. 38B is a longitudinal cross-sectional view taken along line 38B—38B of FIG. 38C showing an alternate embodiment of a connector.
Figure 38A:
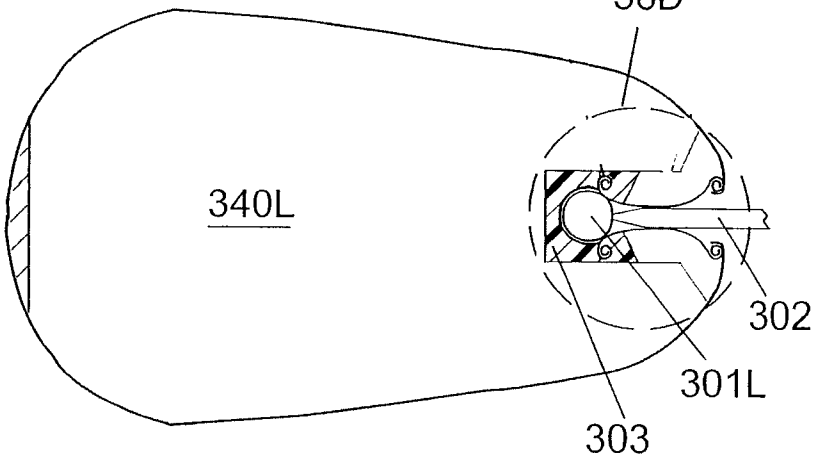
FIG. 38A is a plan view, partly in cross-section showing an alternate embodiment of a connector.
Figure 38E:
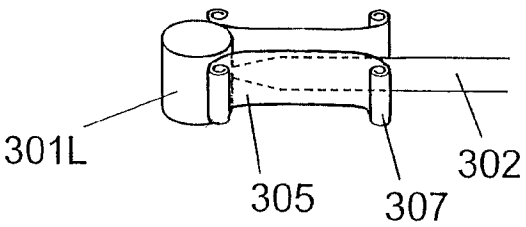
FIG. 38E is a fragmentary perspective view of the alternate embodiment of the connector of FIG. 38D.
Figure 38F:
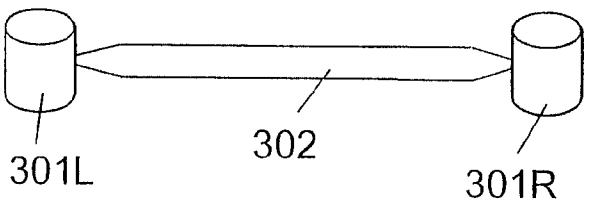
FIG. 38F is a perspective view of the alternate embodiment of the connector of FIG. 38D.
Figure 38G:
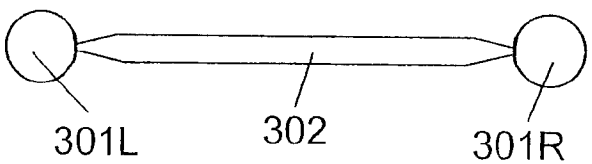
FIG. 38G is a top view of the alternative embodiment of the connector of FIG. 38D.
Figure 38D:
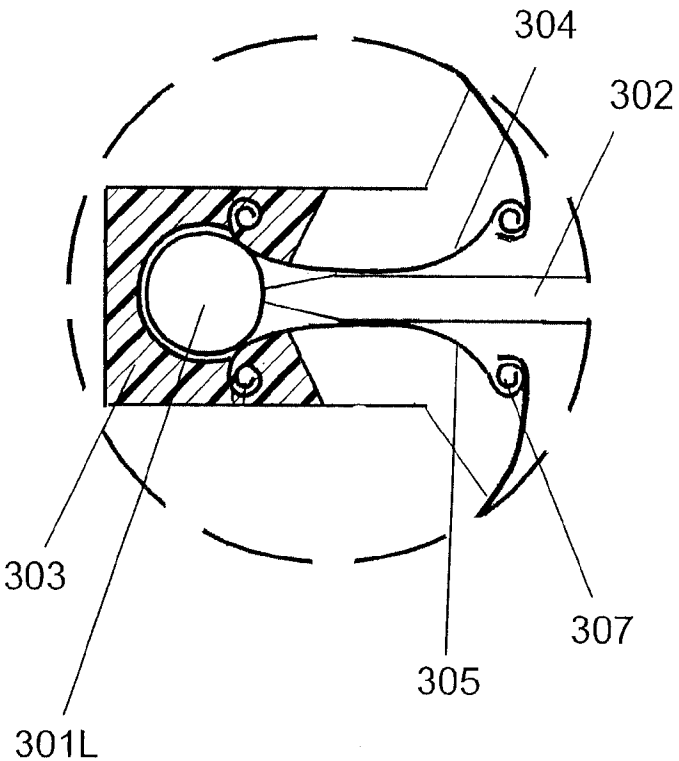
FIG. 38D is an enlarged fragmentary view of the alternate embodiment of the connection of FIG. 38A.

The platform that rides on the snow may be two ridges 180L separated by a concave surface 183L, as illustrated in FIG. 30B. The ridges 180L should be separated sufficiently so that the user may stand on a section and have the section supported in a stable non-tipping manner. A preferable separation should be between two and six inches with about three inches being preferred. Alternatively, the platform may be a flat surface 184L as illustrated in FIG. 37A; or a single ridge 186L embedded in a flat surface 185L as illustrated in FIG. 37B; or a single ridge on a shallow, convex bottom as illustrated in FIG. 37D.

Alternate Embodiments of the Connector.

Number Connectors.

More than one connector may be used to provide a less movable attachment between front and rear sections.

Dimensions of Connector.

The length and girth of the connector may vary. It could be as wide as the width of the front and back sections, or vary narrow. Although its length may be from approximately 2 inches to 5 inches long, it may be less that 2 inches or greater than 5 inches.

Non-Rigid Connector.

There may be situations where a non-rigid connector is preferred over a semi-rigid connector.

Alternate Embodiments of Springable Connector.

Metal Spring Plates Mounted on Each Section.

FIG. 38A, 38B, 38C, 38D, 38E, 38F and 38G illustrate a springable connection that uses an inflexible, non-springable rod 302 connected to a cylinder 301L and 301R. Speaking of the front section 340L, flexible metal plates (such as a leaf spring) 304 and 305 provide a flexible, springable wall for the rod 302 to push against. The cylinder 301L pivots within the reinforced area 303 which holds coil 306. When turning to the left, the rod 302 would push against the metal plate 305, forcing the coil 307 to travel away from the rod in a horizontal direction in open area 308 near trailing edge 359. The same connection assembly is duplicated on the rear section of the present invention, providing a connection which has its ability to spring back and forth located within each section, rather than in the connector itself.

FIG. 39A, 39B, 39C, and 39D illustrate a springable connector 455 made of horizontal metal plates. An upper metal plate 402L and a lower metal plate 403L, protruding from a block 450L, mate with a center metal plate 405. [t] The plates are held in place with a bolt 402L, washers 404 and a locknut 414L. The horizontal joint thus formed could also be created using other materials, such as a horizontal universal joint. A compression spring 401 is secured on the front side 407L to a block 450L and on the rear side 407R to a block 450R. Thus, a springable connection is created using a single joint and spring. Similarly, an upper metal plate 403R and a lower metal plate 413R protrude from block 450R and also mate with a center metal plate 405.

Figure 39C:
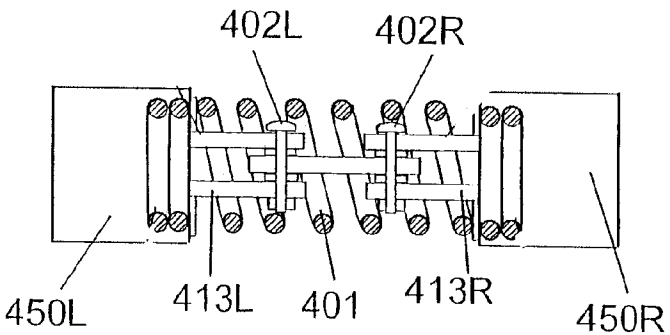
FIG. 39C is a cross-sectional side view of the alternate embodiment of the connector of FIG. 39C.
Figure 39D:
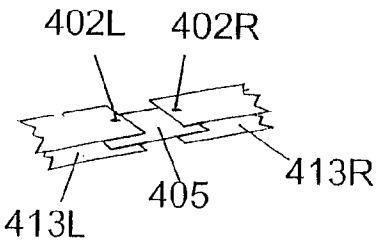
FIG. 39D is a fragmentary perspective view of an arrangement of metal plates used in the alternate embodiment of the connector of FIG. 39A.
Figure 39A:
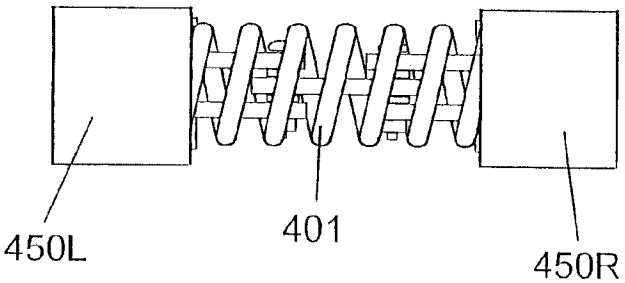
FIG. 39A is a side view of an alternative embodiment of a connector.
Figure 39B:
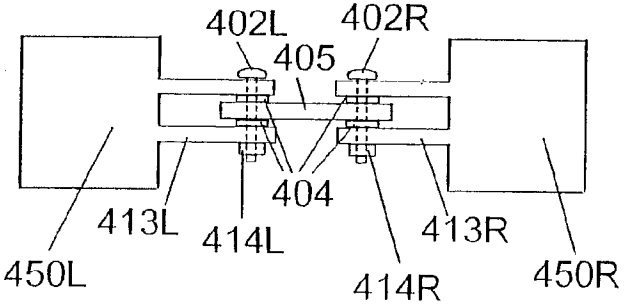
FIG. 39B is a side view of the alternative embodiment of the connector of FIG. 39A without the spring.
Figure 39E:
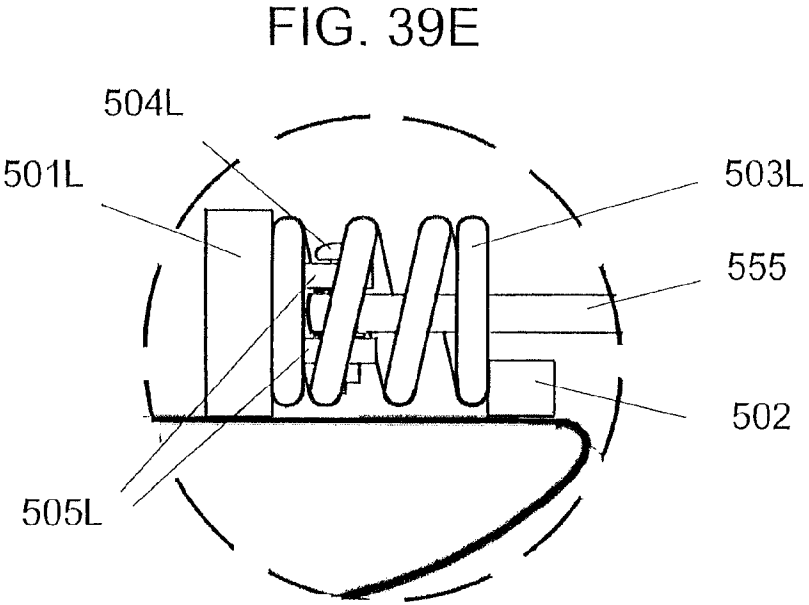
FIG. 39E is an enlarged side view of the alternate embodiment of the connector of FIG. 39F.
Figure 39F:
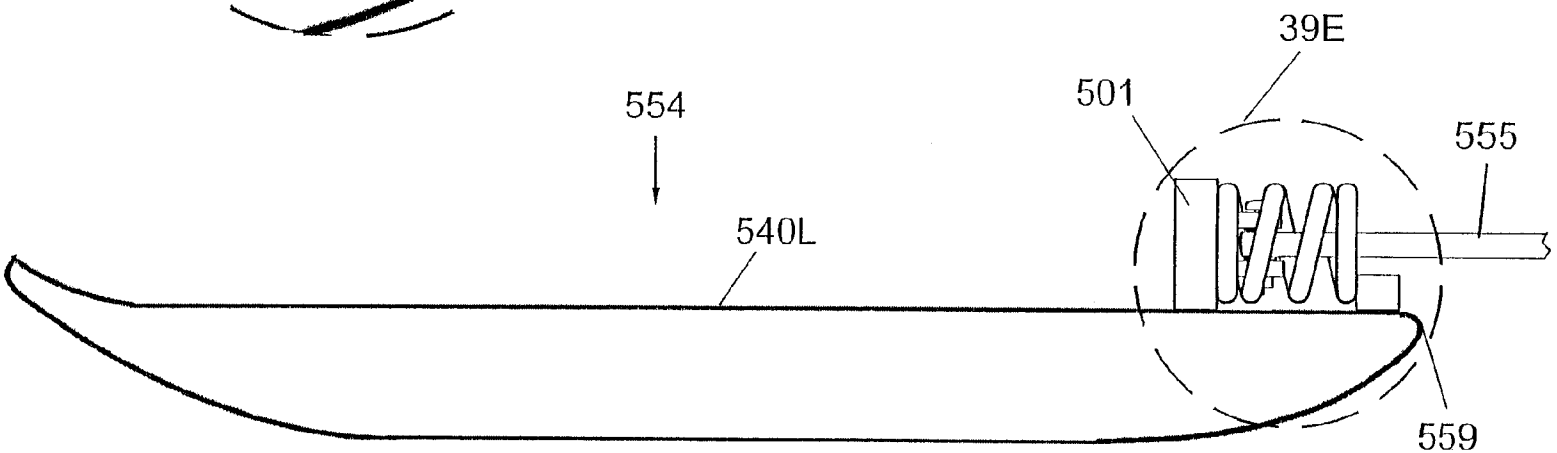
FIG. 39F is a side view of the alternate embodiment of connector which places the springable connection on the front and rear sections connected by an inflexible rod.

FIG. 39E and 39F illustrate a biased connection located on a front section 554 of the present invention having a leading edge 557, a bottom 542L and a trailing edge 559. A spring 503L is secured to a block 501L which is secured to the top surface 540L of the front section. Two metal plates 505L which are secured to block 501L mate to a rod or preferably inflexible metal plate 555. The metal plate 555 is secured to metal plates 505L with a bolt 504L. A block 502 is secured to top surface 540L to further control the spring 503L. When the front section is turned left or right, the metal plate 555 moves horizontally, and is returned to its original position with the spring.

Summary of Alternate Embodiments of Springable Connector.

The connector of the preferred embodiment was continuously flexible and springable. In addition, the springable connector may consist of one or more inflexible segments, or it may be completely inflexible so that the flexibility is provided by its connection to the front and/or rear sections.

Alternate Embodiments of Materials of Construction.

The invention may be constructed of any number of appropriate materials, including carbon fiber, fiberglass, Kevlar, plastic, metal, wood, foam and composite. It is envisioned that commercial production may involve some type of injection or rotational molding.

Conclusions, Ramifications and Scope.

Accordingly, due to its two-piece articulated construction, the convex shape of the bottom of each section, the longitudinal ridges on the bottom surface, and the non-twisting, springable connector between the front and rear sections, this invention offers a rider capabilities not heretofore experienced.

The term "approximately convex" is used in the claims herein to mean largely convex, but also possibly including some flat or even slightly concave portion along a minor part of the lower surface.

Maneuverability, the key advantage of the present invention is made possible with the two-piece construction, the semi-rigid, springable connector and the shape of the bottom. Placement and type of ridges on the bottom provide for further options to change the performance characteristics of the board. When the ridges incorporate blades made of metal or similar material, the rider will be able to easily make controlled turns around even moguls.

The connector is constructed to made with a variety of sections, and sections can easily be interchanged, giving a rider a wide variety of performance choices. In addition, the rider can add, remove or move turning ridges, further increasing choices the invention can be easily dismantled into sections and connector for easy transport and storage.

The advantages of this invention over previous snow riding boards and skis are as follows:

Two-piece construction means increased maneuverability.

Convex bottom glides over and around bumps and moguls.

Longitudinal ridges provide maneuverability and control.

Ridges placed at any angle to the longitudinal access provide more aggressive turning capabilities.

Non-twisting, springable connector contributes to stability and control.

Interchangeable parts means more performance options for the rider at lower cost.

While the above-mentioned specifications are directed to a snowboard, the same structure and characteristics could be used in a waterboard or a board used to surf on sand.

Thus, the foregoing description is considered as illustrative only of the principles of the invention. Furthermore, since numerous modifications and changes will readily occur to those skilled in the art, it is not desired to limit the invention to the exact construction and process shown as described above. Accordingly all suitable modifications and equivalents may be resorted to falling within the scope of the invention.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A two piece articulated board for movement over a surface comprising:

a first section having an upper surface and a lower surface, a right edge and a left edge, an outer end, an inner end, and a first section longitudinal axis lying in a first section vertical plane and a first section horizontal plane;

a second section having an upper surface and a lower surface, a right edge and a left edge, an outer end, an inner end, and a second section longitudinal axis lying in a second section vertical plane and a second section horizontal plane, said second section horizontal plane being co-planar with said first section horizontal plane; and a connector having a forward end affixed adjacent the inner end of said first section and a rearward end affixed adjacent the inner end of said second section so that the inner end of the first section is separated from the inner end of the second section, said connector being a flat length of spring steel having two side faces and an upwardly directed edge and a downwardly directed edge, said flat length being vertically oriented so that the first and second sections will move more easily to the right and left as viewed from the top than they will move up and down as viewed from the side, said flat length of spring steel being held at a forward end in a forward receptacle affixed to said first section and being held at a rearward end in a rearward receptacle affixed to said second section, said flat length of spring steel being affixed with sufficient rigidity so that it will bias the connector into a central position so that the first section longitudinal axis is substantially parallel to the second section longitudinal axis.

2. The two piece articulated board of claim 1 wherein said length of spring steel is removably held in said forward receptacle.

3. The two piece articulated board of claim 1 wherein said length of spring steel is removably held in said rearward receptacle.

4. The two piece articulated board of claim 1 wherein said length of spring steel is removably held in said forward and rearward receptacles.

5. The two piece articulated board of claim 1 wherein said lower surface of said first section and said second section is somewhat convex when viewed along a vertical plane normal to the longitudinal axis of the respective first and second sections.

6. The two piece articulated board of claim 5 wherein said lower surface of said first section and said second section have a pair of ridges separated by a concave surface and said pair of ridges being spaced about three inches apart.

7. The two piece articulated board of claim 6 further including an angled ridge adjacent said right and left edges of said first section and said second section, each of said angled ridges being closer together near said inner end of said first and second sections than at the outer end.

8. A two piece articulated board for movement over a surface comprising:

a first section having an upper surface and a lower surface, a right edge and a left edge, an outer end, an inner end, and a first section longitudinal axis lying in a first section vertical plane and a first section horizontal plane;

a second section having an upper surface and a lower surface, a right edge and a left edge, an outer end, an inner end, and a second section longitudinal axis lying in a second section vertical plane and a second section horizontal plane, said second section horizontal plane being co-planar with said first section horizontal plane; and a connector having a forward end affixed next to the inner end of said first section and a rearward end affixed next to the inner end of said second section so that the inner end of the first section is separated from the inner end of the second section, said connector being a non-twisting connector configured to flex so that the first section vertical plane may flex out of alignment with the second section vertical plane while the first section horizontal plane remains co-planar with the second section horizontal plane, further including means for biasing said connector into a central position so that the first section vertical plane is urged toward alignment with the second section vertical plane.

9. The two piece articulated board of claim 8 wherein said connector includes a horizontal plate hingedly connected to forward fitting affixed to said first section and to a rearward fitting affixed to said second section and said forward fitting and said rearward fitting being interconnected by a spring to urge said first section and said second section into alignment with each other.

10. The two piece articulated board of claim 8 wherein said connector is a rigid connector and is affixed to at least one of said first section and said second section by a cylinder which is twistably mounted to said at least one of said first section and said second section.

11. The two piece articulated board of claim 10 wherein said rigid connector is affixed to both said first and second sections by a cylinder which is twistably mounted to said first and second sections.

12. The two piece articulated board of claim 11 wherein said rigid connector is biased to align with the first section longitudinal axis and with the second section longitudinal axis.

13. The two piece articulated board of claim 12 wherein said rigid connector is contacted by a pair of springs held by said first section, one positioned on a right side of said rigid connector and one positioned on a left side of said rigid connector and by a pair of springs held by said second section, one positioned on a right side of said rigid connector and one positioned on a left side of said rigid connector.

* * * * *